US005134915A

United States Patent [19]

Fukano et al.

[11] Patent Number: 5,134,915

[45] Date of Patent: Aug. 4, 1992

[54] ROLLED-PAPER FEED UNIT FOR AN IMAGE FORMING APPARATUS

[75] Inventors: Masahiko Fukano, Osaka; Hiroshi Kajita, Kobe; Nobuhiro Nishioka, Osaka; Koji Izumi, Toyonaka; Mitsutoshi Takemoto, Yao; Masazo Matsuda, Habikino, all of Japan

[73] Assignee: Mita Industrial Co., Ltd., Osaka, Japan

[21] Appl. No.: 669,590

[22] Filed: Mar. 14, 1991

[30] Foreign Application Priority Data

| | | | |
|---|---|---|---|
| Mar. 19, 1990 | [JP] | Japan | 2-70801 |
| Mar. 19, 1990 | [JP] | Japan | 2-70802 |
| Mar. 19, 1990 | [JP] | Japan | 2-70803 |
| Jul. 10, 1990 | [JP] | Japan | 2-183697 |
| Jul. 10, 1990 | [JP] | Japan | 2-183701 |

[51] Int. Cl.[5] ..... G03G 21/00

[52] U.S. Cl. ..... 83/563; 83/649; 83/859; 83/949; 242/58.6; 355/310

[58] Field of Search ..... 83/649, 859, 563, 949; 355/310, 309; 242/58.6

[56] References Cited

U.S. PATENT DOCUMENTS

| | | | |
|---|---|---|---|
| 3,321,147 | 5/1967 | Martin | 242/58.6 |
| 3,788,175 | 1/1974 | Davis | 83/649 X |
| 4,967,240 | 10/1990 | Kitano | 355/309 X |
| 4,969,016 | 11/1990 | Kudoh | 355/310 |

FOREIGN PATENT DOCUMENTS

| | | |
|---|---|---|
| 2537574 | 4/1976 | Fed. Rep. of Germany . |
| 2743967 | 10/1979 | Fed. Rep. of Germany . |

*Primary Examiner*—Frank T. Yost
*Assistant Examiner*—Kenneth E. Peterson
*Attorney, Agent, or Firm*—Berveridge, DeGrandi & Weilacher

[57] ABSTRACT

The rolled-paper feed unit for an image forming apparatus of the present invention comprises; a movable body for reeling out and feeding rolled paper and for cutting the rolled paper into a cut sheet having a predetermined length; and a stationary frame which holds the movable body vertically moved from an upper position where the rolled paper is fed to a lowered retreat position where the operator is adapted to carry out certain operations. When feeding the rolled paper to the image forming apparatus main body, the movable body is held at the upper position. When resupplying cut paper to a cassette mounted on the image forming apparatus, or executing a jam processing or the like, the movable body is lowered.

37 Claims, 23 Drawing Sheets

ROLLED-PAPER FEED UNIT FOR AN IMAGE FORMING APPARATUS

BACKGROUND OF THE INVENTION

1. Field of the Invention

The present invention relates to a rolled-paper feed unit connected to an image forming apparatus such as an electrostatic photographic copying apparatus, a facsimile or the like.

2. Description of the Related Arts

An image forming apparatus (for example, an electrostatic photographic copying apparatus) is generally arranged such that cut paper sheets in a paper feed cassette mounted on the main body of the image forming apparatus are automatically fed one by one to an image forming unit. In another case, cut paper sheets are manually fed one by one to the image forming unit through a manual paper feed port.

Such an image forming apparatus requires a greater paper storing space as the size of cut paper used for image forming is greater. In this connection, provision is made such that rolled paper is set in a rolled-paper cutting device disposed independently from the image forming apparatus and that a cut paper sheet as previously cut to a desired size from the rolled paper is fed to the image forming unit. However, it is not only very troublesome but also very ineffective to cut the rolled paper into a paper sheet each time by using the device separated from the image forming apparatus.

Alternately, it may be proposed that the image forming apparatus incorporates the rolled-paper cutting device such that rolled paper is cut into a sheet having desired sizes and fed to the image forming unit when the paper feed mode is switched from a setting for feeding original cut paper (hereinafter referred to as a cut-paper feed mode) to a setting for feeding rolled paper (hereinafter referred to as a rolled-paper feed mode). In this case, it is required to newly design and manufacture a special image forming apparatus having a complicated arrangement, thereby to increase the cost. Further, the user already possessing an image forming apparatus provided with a cut paper feed function or a manual paper feed function, is required to further purchase an image forming apparatus incorporating a rolled-paper cutting device. Thus, the existing image forming apparatus comes to nothing.

SUMMARY OF THE INVENTION

Accordingly, the present invention is proposed with the object of providing a rolled-paper feed unit which can be jointly used with an existing image forming apparatus, and in which an original cut-paper feed mode and a rolled-paper feed mode are adapted to be selected, and which is improved in safety at the time of maintenance of jam processing or the like, yet assuring convenient maneuverability of maintenance.

It is another object of the present invention to provide a rolled-paper feed unit which can prevent an error, such as inclined cut of rolled paper, apt to take place at the time when the paper feed mode is switched from the cut-paper feed mode to the rolled-paper feed mode.

It is a further object of the present invention to provide a rolled-paper feed unit in a compact design in its entirety.

It is still another object of the present invention to provide a rolled-paper feed unit improved in safety.

To achieve the objects above-mentioned, the rolled-paper feed unit for an image forming apparatus in accordance with a first aspect of the present invention comprises: a movable body including a rolled-paper mounting portion, a paper feed means for reeling out and feeding rolled paper to a paper feed port disposed at the front of the image forming apparatus main body, and a rolled-paper cutting means for cutting the rolled paper reeled out by the paper feed means, into a cut sheet having a predetermined length; a stationary frame which holds the movable body vertically moved from an upper position where the rolled paper is fed to a lower retreated position where the operator may carry out certain operations; and a movable body biasing means obliquely disposed between the bottom of the movable body and the bottom frame of the stationary frame for normally biasing the movable body toward the upper position.

According to the present invention, an existing image forming apparatus may be used, as it is, providing with the existing cut-paper feed mode and the rolled-paper feed mode. The rolled paper may be fed to the image forming apparatus main body by the movable body held at the upper position. Further, the certain operations such as the resupply of cut paper to a cassette mounted on the image forming apparatus main body, a jam processing or the like, may be carried out by retreating the movable body for preventing it from getting in the way. A cut sheet may be obtained by the rolled-paper cutting means cutting the rolled paper. It is therefore possible to obtain a large-size cut sheet without the corresponding space required as would be the case with paper feed in cassette.

According to the first aspect of the present invention, the movable body may be vertically moved merely by applying a slight upward or downward force to the movable body. When the movable body is upper, the movable body biasing means strongly biases the movable body holding therefor, and when the movable body is lower, the biasing means weakly biases the movable body. In both cases, the movable body may be stably held with the biasing and holding force of the biasing means. Further, the stroke of the biasing means may be small, so that the mechanism for vertically moving and holding the movable body may be made compact. This makes the entire rolled-paper feed unit in a smalll size.

The rolled-paper feed unit for an image forming apparatus in accordance with a second aspect of the present invention comprises: a movable body for reeling out and feeding rolled paper and for cutting the rolled paper into a cut sheet having a predetermined length; a stationary frame which holds the movable body vertically moved from an upper position where the rolled paper is fed, to a lower retreated position where the operator may carry out certain operations; a position regulating means for upwardly regulating the movable body at opposite sides in an axial direction of the rolled paper; and a fixing means for fixing the movable body regulated upwardly to the stationary frame. The movable body includes a rolled-paper mounting portion, paper feed means for reeling out and feeding the rolled paper to a paper feed port at the front of an image forming apparatus main body, and rolled-paper cutting means for cutting the rolled paper reeled out by the paper feed means into a cut sheet having a predetermined length.

According to the second aspect of the present invention, an existing image forming apparatus may also be used, as it is, providing with the existing cut-paper feed mode and the rolled-paper feed mode. Further, the certain operations, such as the resupply of cut-paper to a cassette mounted on the image forming apparatus main body, a jam processing or the like, may also be carried out. It is also possible to obtain a large-size cut sheet without the corresponding space required as would be the case with paper feed in cassette.

According to the second aspect of the present invention, by initially setting the relating position of the stationary frame with respect to the image forming apparatus main body in such a way that the movable body is held so that the paper discharge port faces the paper feed port of the image forming apparatus main body and the stationary frame is adjusted in horizontal level so that axes of various rollers in the rolled-paper feed unit of the main body are parallel with axes of various rollers in the image forming apparatus main body, the parallelism of the axes of the rollers are maintained after merely fixing the movable body at the upper position.

The rolled-paper feed unit for an image forming apparatus in accordance with a third aspect of the present invention comprises: a movable body for reeling out and feeding rolled paper and for cutting the rolled paper into a cut sheet having a predetermined length; and a stationary frame which holds the movable body vertically moved from an upper position where the rolled paper is fed, to a lower retreated position where the operator may carry out certain operations. The movable body includes a rolled-paper mounting portion, a paper feed means for reeling out and feeding the rolled paper to a paper feed port at the front of an image forming apparatus main body, and rolled-paper cutting means for cutting the rolled paper reeled out by the paper feed means into a cut sheet having a predetermined length. The movable body has a drive system for the rolled-paper cutting means. The drive system is connected to a drive means mounted on the stationary frame through a power transmission mechanism in which the engagement state is released with the downward movement of the movable body from the paper feed position.

According to the third aspect of the present invention, an existing image forming apparatus may also be used, as it is, providing with the existing cut-paper feed mode and the rolled-paper feed mode. Further, the certain operations, such as the resupply of cut paper to a cassette mounted on the image forming apparatus main body, a jam processing or the like, may also be carried out. It is also possible to obtain a large-size cut sheet without the corresponding space required as would be the case with paper feed in cassette.

According to the third aspect of the present invention, because the drive system is released from the power transmission mechanism and the power transmission to the drive system of the rolled-paper feed unit is disengaged as the movable body is lowered from the paper feed position, even though the switch is erroneously operated to start the drive means at the time of maintenance with the movable body lowered, there is no possibility that the rolled-paper feed unit or the rolled-paper cutting means is driven.

The rolled-paper feed unit for an image forming apparatus in accordance with a fourth aspect of the present invention comprises: a movable body for reeling out and feeding rolled paper and for cutting the rolled paper into a cut sheet having a predetermined length; and a stationary frame which holds the movable body vertically moved from an upper position where the rolled paper is fed, to a lower retreated position where the operator may carry out certain operations. The movable body includes a rolled-paper mounting portion, a paper feed means for reeling out and feeding the rolled paper to a paper feed port disposed at the front of an image forming apparatus main body, a rolled-paper cutting means for cutting the rolled paper reeled out and fed by the paper feed means, into a cut sheet having a predetermined length. One of the movable body and the stationary frame has a pair of vertically extending racks provided with a predetermined space therebetween, and the other of the movable body and the stationary frame has a pair of integrally rotatable pinions meshed with the racks.

According to the fourth aspect of the present invention, an existing image forming apparatus may also be used, as it is, providing with the existing cut-paper feed mode and the rolled-paper feed mode. Further, the certain operations, such as the resupply of cut paper to a cassette mounted on the image forming apparatus main body, a jam processing or the like, may also be carried out. It is also possible to obtain a large-size cut sheet without the corresponding space required as would be the case with paper feed in cassette.

According to the fourth embodiment, the amounts of vertical movement of the movable body at both transverse sides thereof are made equal by these racks and pinions. This prevents the movable body from being transversely inclined.

Other objects, arrangement and operational effects of the present invention will be apparent from the following detailed description with reference to the attached drawings.

DESCRIPTION OF THE PREFERRED EMBODIMENTS

The following description will discuss embodiments of the present invention with reference to the attached drawings.

Figure 1:
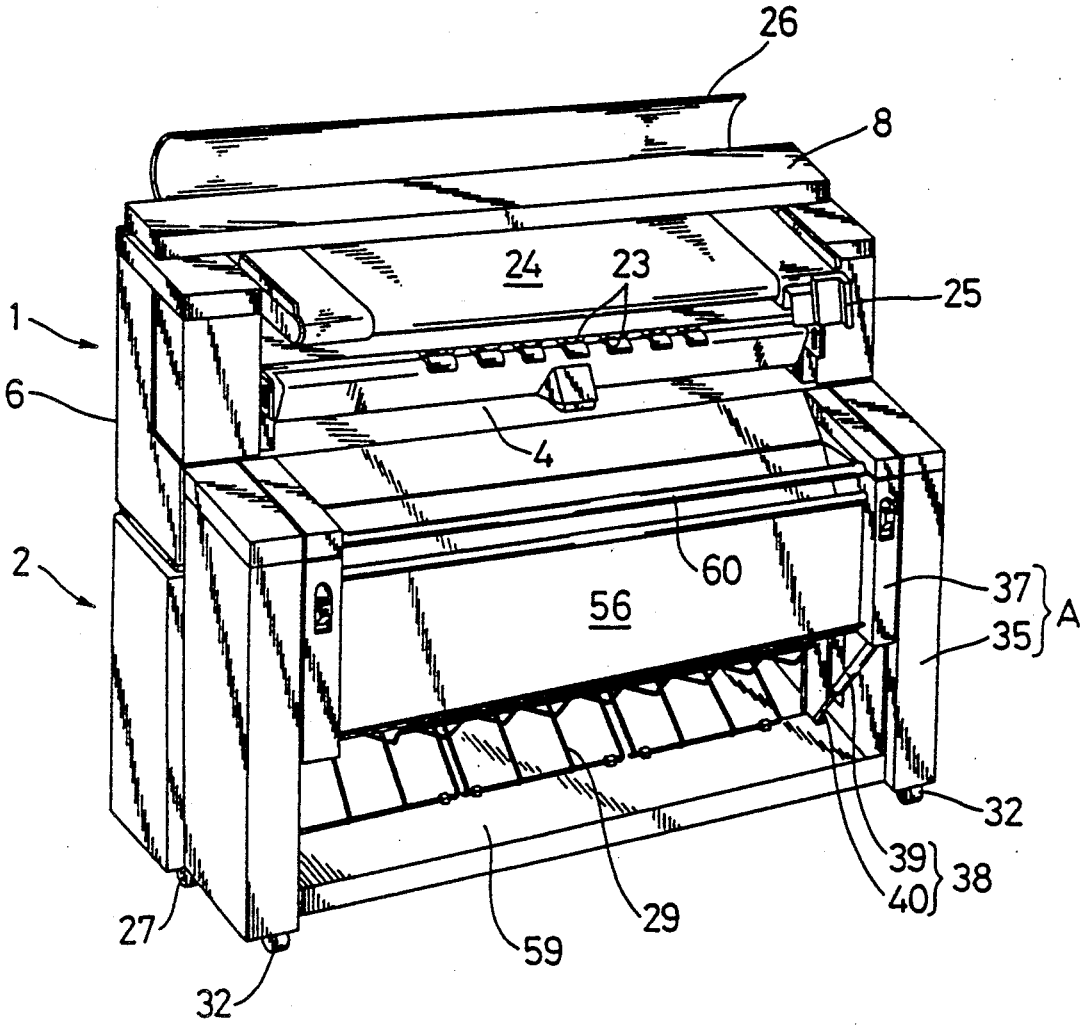
FIG. 1 is a schematic perspective view of an image forming apparatus in accordance with a first embodiment of the present invention.
Figure 2:
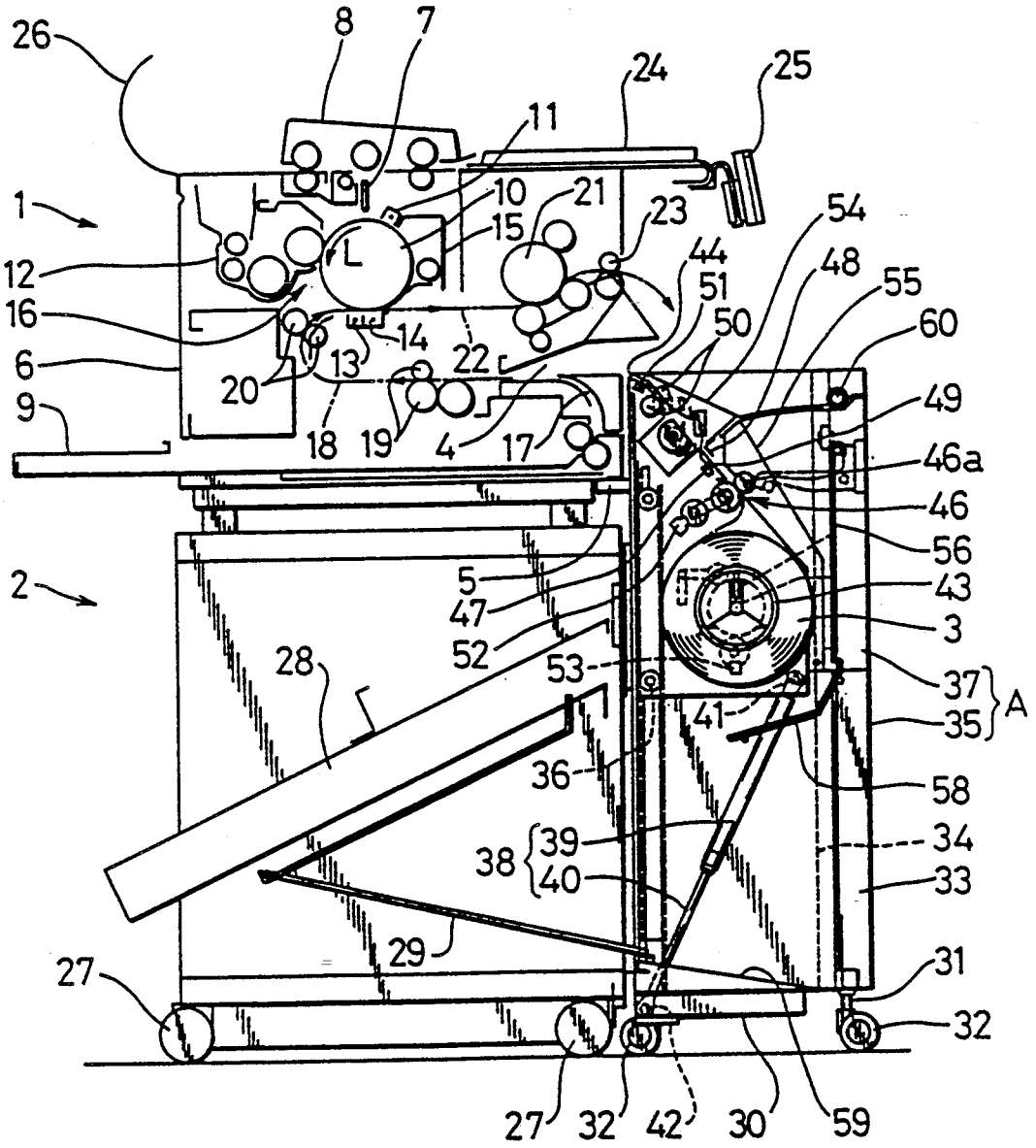
FIG. 2 is a schematic vertical section view of the image forming apparatus shown in FIG. 1.
Figure 3B:
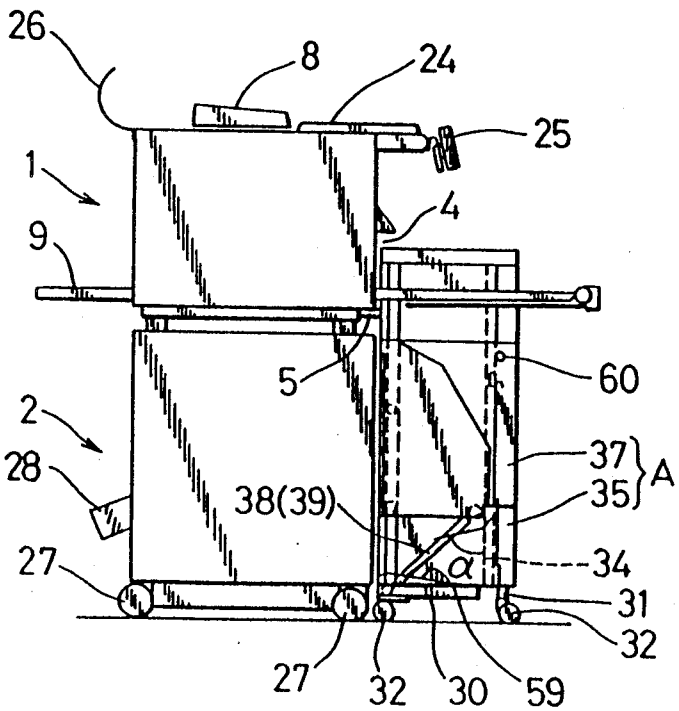
FIGS. 3*a* and 3*b* are views illustrating the operation of the image forming apparatus shown in FIG. 1.
Figure 3A:
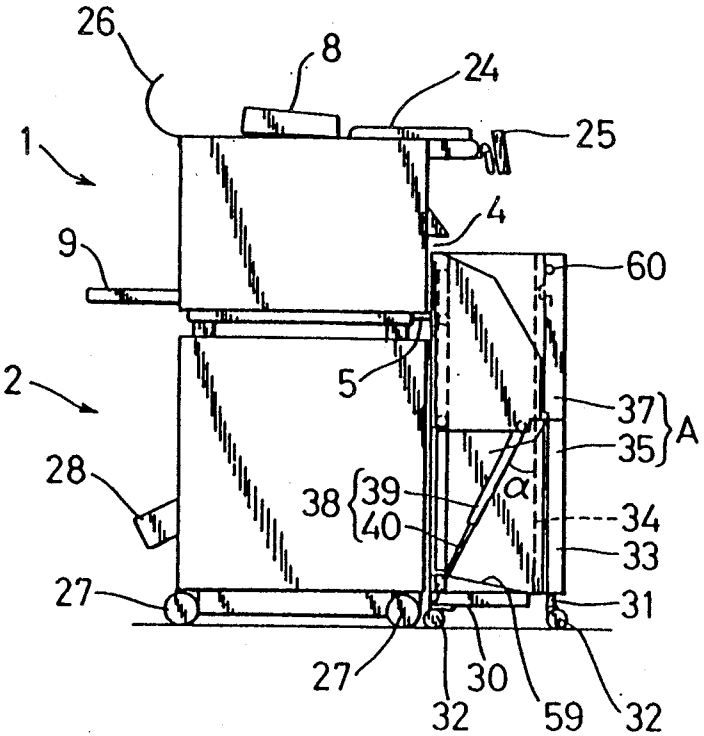
Figure 4:
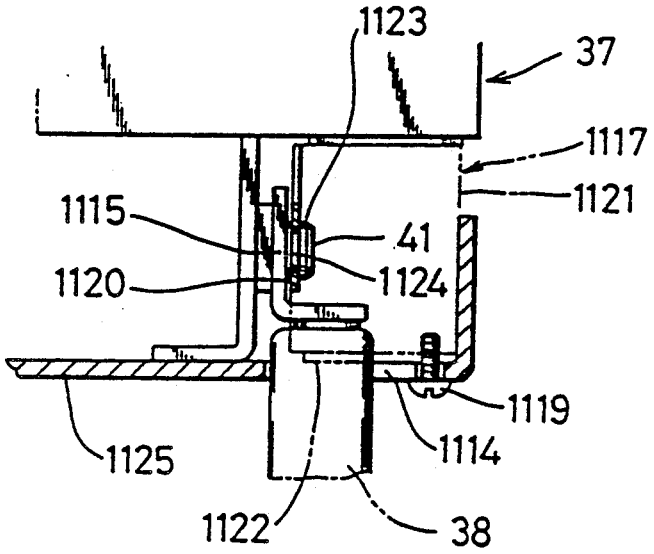
FIG. 4 is a transverse section view of main portions of the second embodiment in FIG. 1.
Figure 5:
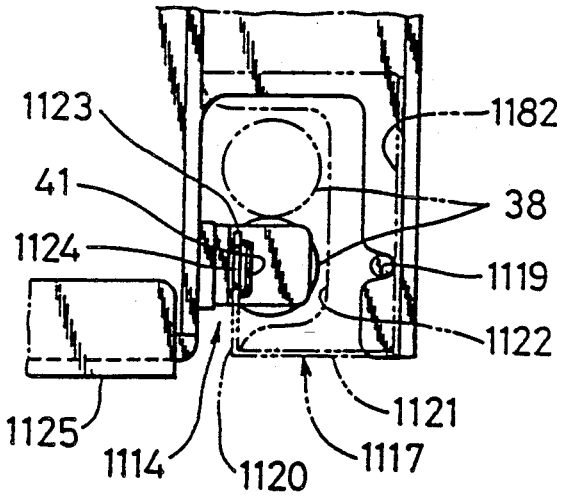
FIG. 5 is a transverse section view of main portions of the second embodiment in FIG. 1.
Figure 6:
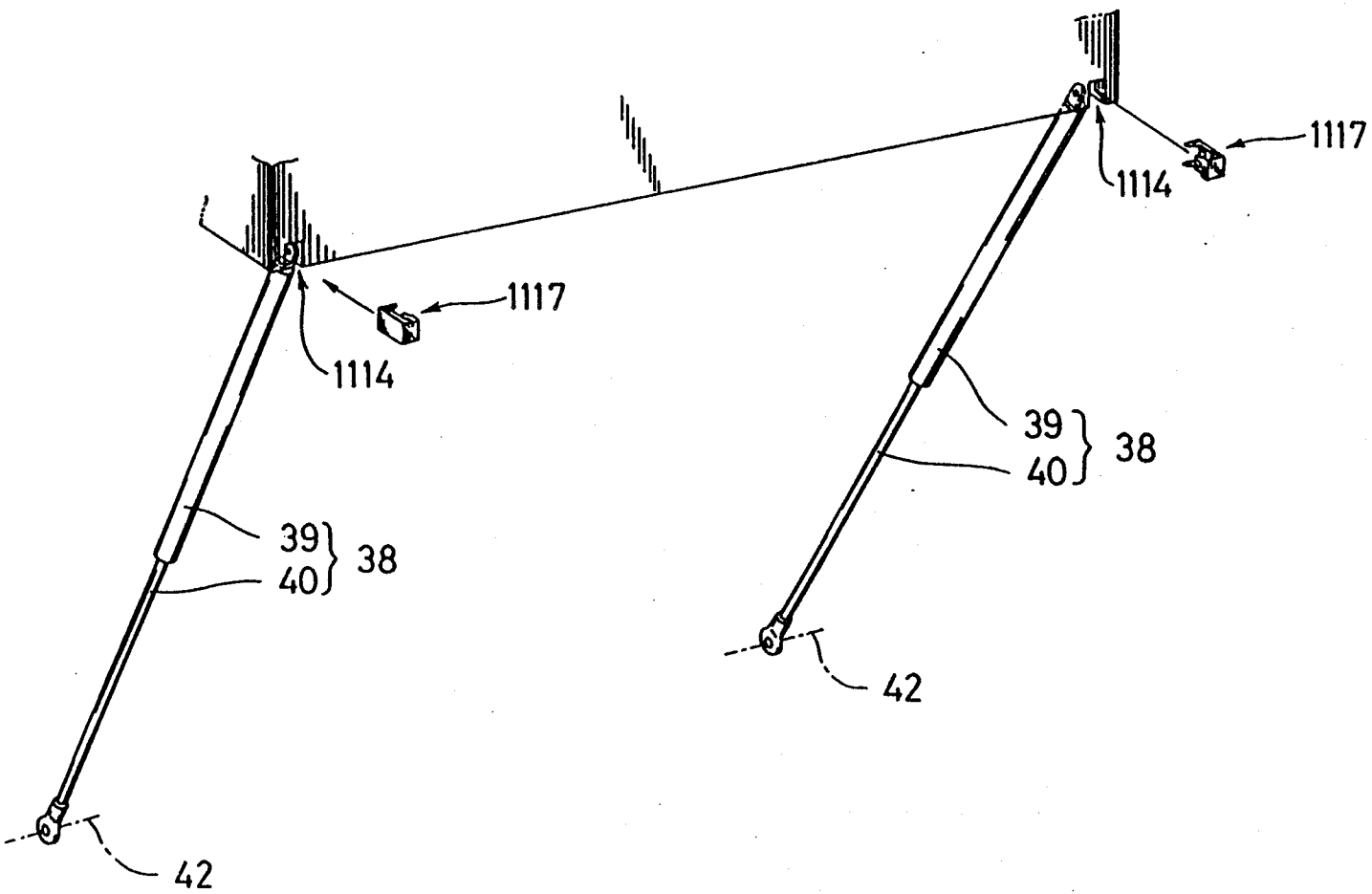
FIG. 6 is an exploded perspective view of main portions of the second embodiment in FIG. 1.

In an embodiment of the present invention shown in FIGS. 1 to 3, FIGS. 1 and 2 show the general arrangement of an electrostatic photographic copying apparatus which is an example of an image forming apparatus. In FIGS. 1 and 2, the main body 1 of the copying apparatus is mounted on a movable deck 2 and a rolled-paper feed unit A is connected to the copying apparatus main body 1 through a connecting member 5 for feeding rolled paper 3 (FIG. 2) to a manual paper feed port 4 of the copying apparatus main body 1.

Referring to FIG. 2, the following description will discuss the arrangement of the copying apparatus main body 1.

Reciprocating means 8 is disposed at the upper portion of an apparatus casing 6 for moving document with respect to an exposure device 7. Disposed at the lower portion of the apparatus casing 6 is a large-size paper feed cassette 9 which may be pulled out toward the rolled-paper feed unit A.

A photoreceptor 10 is so disposed inside of the apparatus casing 6 as to be rotatable in a direction of an arrow L. A charging device 11, the exposure device 7, a developing device 12, a transferring device 13, a paper separating device 14 and a cleaning device 15 are disposed around the photoreceptor 10, thus forming an image forming unit 16.

A paper delivery guide 17 extends from the paper feed port of the paper feed cassette 9 to the manual paper feed port 4, and a paper delivery passage 18 extends from the manual paper feed port 4 to the transferring device 13. Disposed in the paper delivery passage 18 are a pair of delivery rollers 19 as delivery means for delivering transfer paper from the paper feed port of the paper feed cassette 9 or the manual paper feed port 4 toward the transferring device 13. A pair of resist rollers 20 are disposed between the delivery rollers 19 and the transferring device 13. A paper delivery passage 22 is formed between the paper separating device 14 and a fixing device 21 for fixing an image on the transfer paper after paper separation and image transfer. A pair of paper discharging rollers 23 are disposed downstream of a paper delivery passage 22 formed between the fixing device 21 and the paper separating device 14. There are also formed and disposed a document feed passage 24, a document terminal end detecting device 25 and a document inverting device 26.

The movable deck 2 is provided at the underside thereof with caster wheels 27 and incorporates a transfer paper stocking unit 28 as inclined upwardly toward the front side, the stocking unit 28 being removable. A bent guide member 29 is removably disposed under the stocking unit 28.

The following description will discuss the arrangement of the rolled-paper feed unit A.

Caster wheels 32 are threadedly connected, through screw shafts 31, to the four corners of the underside of a bottom frame 30. Vertical frames 33 stand from the bottom frame 30 at both lateral sides thereof. Vertically extending guide rails 34 are disposed at the front and rear sides of the vertical frames 33. Thus, there is formed a unit frame 35, as an example of a stationary frame, of which level and place are adjustable. Rollers 36 rotatable along the guide rails 34 are disposed at the upper and lower portions of a unit body 37 as a movable body. Disposed at both lateral sides of the rolled-paper feed unit A are gas springs 38 as movable body biasing means for vertically movably holding the unit body 37, the gas springs 38 extending from the bottom frame 30 to the unit body 37.

Each of the gas springs 38 has a cylinder 39, a rod 40 and gas encapsulated under such a predetermined pressure as to stretch the rod 40 in the cylinder 39. In the embodiment shown in FIGS. 1 and 2, the gas springs 38 are positioned transversely symmetrically of the unit body 37 and are inclined upwardly toward the front side of the rolled-paper feed unit A between the bottom of the unit body 37 and the bottom frame 30 of the unit frame 35. The upper and lower ends of the gas springs 38 are rotatably pivoted by transverse pivot pins 41, 42.

A rolled-paper mounting portion 43 is disposed at the lower portion of the unit body 37. A paper passage is formed between a paper feed port at the upper portion of the rolled-paper mounting portion 43 and a paper discharge port 44 toward the manual paper feed port 4 of the copying apparatus main body 1. Disposed in the paper passage above-mentioned are a pair of paper feed rollers 46 serving as rolled-paper feeding means, a field switch 47 for detecting whether or not the tip of the rolled paper 3 is present, a tip holding member 48 for holding the tip of the rolled paper 3, a rolled-paper cutting means 49 for cutting the rolled paper 3 into a cut sheet having a predetermined length at predetermined timing, a pair of paper discharge rollers 50 and a paper discharge switch 51. A rotational amount detecting device 52 is adapted to supply a pulse signal according to the rotation of the paper feed rollers 46. A rotation detecting device 53 for detecting the rotation of the rolled paper 3 is adapted to supply a pulse signal only when the rolled paper 3 is rotated.

A paper discharge guide 54 is obliquely disposed above the rolled-paper cutting means 49. As covering the rolled-paper mounting portion 43, a cover 55 also serving as a paper discharge guide surface is openably disposed at the front side of the rolled-paper feed unit A. The cover 55 holds the follower roller 46a out of the paper feed rollers 46. The cover 55 forms a paper discharge passage together with a guide plate 56. Also disposed is a guide member 58 for guiding cut paper discharged through the paper discharge passage above-mentioned, toward the movable deck 2. A tray 59 is connected to the bent guide member 29 disposed at the movable deck 2. A tie-rod 60 is horizontally disposed at the upper portion of the front side of the unit body 37.

The devices and members of the electrostatic photographic copying apparatus are adapted to be controlled by a control device (not shown).

With reference to FIG. 3 (1), the following description will discuss how to connect the rolled-paper feed unit A to the copying apparatus main body 1 in the electrostatic photographic copying apparatus having the arrangement above-mentioned.

The unit frame 35 is first moved to a predetermined position at the front side of the copying apparatus main body 1 and the unit body 37 is raised through the connecting member 5. When the unit body 37 is upper, the inclination angle $\alpha$ of each gas spring 38 with respect to the gravity direction, i.e., the perpendicular direction, is small. Accordingly, the gas springs 38 apply strong upward biasing forces to the unit body 37. When the unit body 37 is raised to a position higher than a predetermined position, the upward biasing forces of the gas springs 38 become stronger than the gravity of the unit body 37 due to the mass thereof. Accordingly, when the unit body 37 is located in the highest position, the unit body 37 is held in a stable manner by the gas springs 38 with the rods 40 most stretched. This prevents the unit body 37 from being lowred, without special stop means added. In such a state, the unit body 37 may be fixed by the connecting member 5 so that the rolled-paper feed unit A is set at a predetermined paper feed position.

Then, by turning a start key at an operation/display unit (not shown) ON, the paper feed rollers 46 rotate to feed the rolled paper 3 toward the copying apparatus main body 1.

There are instances where the paper feed cassette 9 is to be pulled out toward the rolled-paper feed unit A in order to resupply cut paper to the paper feed cassette 9, or where a jam processing is to be carried out in the copying apparatus main body 1. In such a case, the unit body 37 should be lowered to such a position as to get out of the way. As shown in FIG. 3 (2), the connecting member 5 may be released and a downward force may be applied to the tie-rod 60 so that the unit body 37 may be lowered. While the unit body 37 is being lowered, the upward biasing forces of the gas springs 38 are still applied, but the inclination angles $\alpha$ above-mentioned are gradually increased to weaken the biasing forces above-mentioned. When the unit body 37 is lowered to a position lower than a predetermined position, the relationship between the gravity of the unit body 37 due to the mass thereof and the upward biasing forces of the gas springs 38 is reversed so that the gravity becomes greater than the biasing forces. Accordingly, when the unit body 37 is located in the lowest position, the unit body 37 is held in a stable manner by the gas springs 38 with the rods 40 most contracted. This prevents the unit body 37 from being raised, without special stop means added.

In the rolled-paper feed unit A having the arrangement above-mentioned, the gas springs 38 for resiliently holding the unit body 37 such that the unit body 37 is vertically movable, are obliquely disposed. Such an arrangement shortens the strokes of the gas springs 38 as compared with the arrangement where the gas springs 38 are vertically disposed. Thus, the mechanism for vertically moving and holding the unit body 37 may be made in a compact design, and there is no need to dispose a control system for vertically moving the unit body 37.

It is merely required to dispose the gas springs 38 transversely symmetrically of the unit body 37. Accordingly, the gas springs 38 may be disposed such that the upper ends thereof are obliquely disposed ao as to downwardly apart from each other when viewed from the front side of the unit A.

The electrostatic photographic copying apparatus may also be used in a cut-paper feed mode where cut paper is fed, without the use of the rolled-paper feed unit A. In such a case, cut paper may be fed from the manual paper feed port 4 or the paper feed cassette 9. At this time, the rolled-paper feed unit A need not to be separated from the main body 1. The paper feed mode may be set by a mode selection key at the operation/display unit (not shown).

The following description will discuss the arrangement of the pivotal connections at the upper ends of the gas springs 38.

Figure 7:
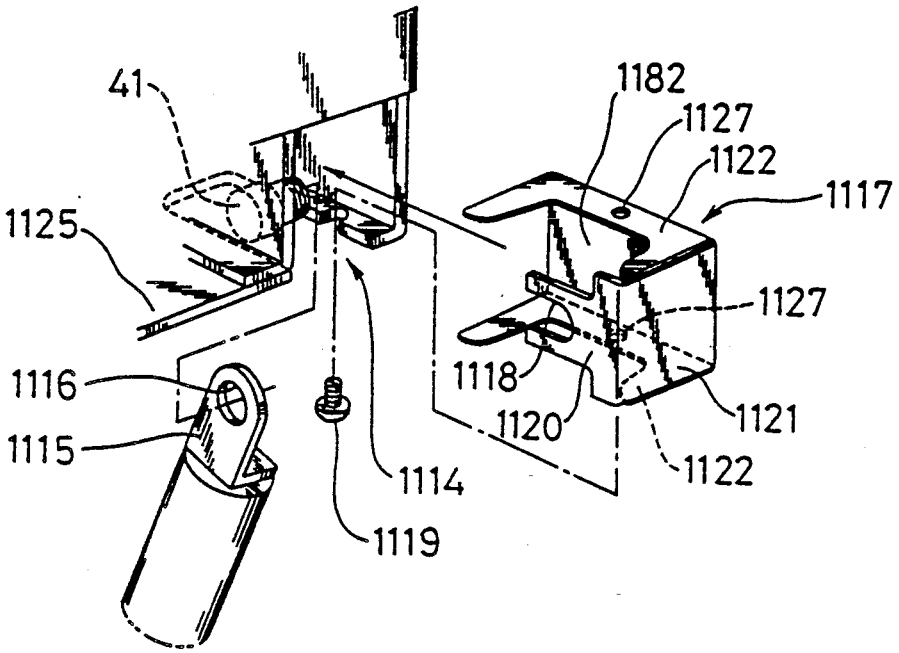
FIG. 7 is an exploded perspective view of main portions of the second embodiment in FIG. 1.
Figure 8:
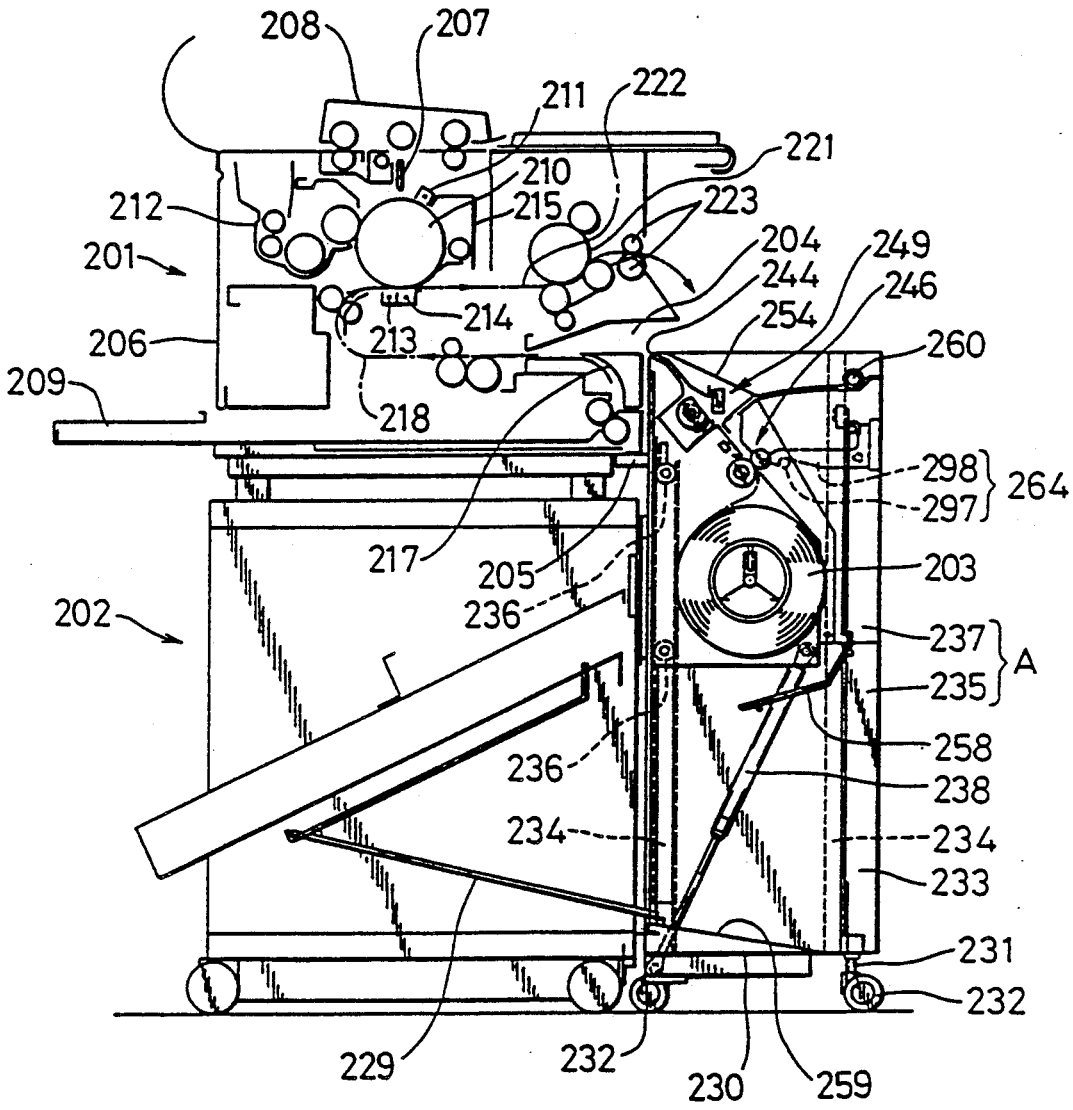
FIG. 8 is a schematic vertical section view of an image forming apparatus in accordance with a third embodiment of the present invention.

As shown in FIGS. 4 to 7, a base 1125 of the unit body 37 has notches 1114 which are opened in the underside and front side of the unit body 37. From the lateral plates of the unit body 37, pivot pins 41 project, in a cantilever manner, inside of the notches 1114 for supporting the rolled-paper mounting portion 43, the rolled-paper feed rollers 46 serving as rolled-paper feed means, the rolled-paper cutting means 49 and the like. Connection plates 1115 each having a pin hole 1116 are formed at the upper ends of the gas springs 38. The pivot pins 41 are fitted in the pin holes 1116. Securing means 1117 are fixed to the base 1125 with fixing means 1119 such as screws for preventing the connection plates 1115 from coming out from the pivot pins 41, as well as for assuring the safety. More specifically, each securing means 1117 in FIG. 7, is vertically symmetric and has, in a unitary structure, a pivot-pin coming-out prevention plate 1120 having a pivot-pin engagement groove 1118 which is rearwardly opened, a lateral side cover portion 1121 for closing the lateral opening of each notch 1114, a pair of upper and lower underside cover portions 1122 for closing the excessive opening portion of the underside opening of each notch 1114 (which refers to other opening portion than the opening area required for expansion and contraction of each gas spring 38), and a vertical plate portion 1182 disposed between the underside cover portions 1122. Each securing means 1117 is made by bending a single metallic plate such that the members above-mentioned are formed. The securing means 1117 is fixed to the base 1125 with the fixing means 1119 with the pivot-pin coming-out prevention plates 1120 fitted between the large-diameter head portions 1123 of the pivot pins 41 projecting through the pin holes 1116 and the connection plates 1115 (more specifically, annualar grooves 1124 formed in the pivot pins 41). Fixing-means insertion holes 1127 are formed in the underside cover portions 1122.

To prevent the lower ends of the gas springs 138 from coming out from the pivot pins 42, E-rings (not shown) are fitted in the annular grooves in the pivot pins 42.

With the arrangement above-mentioned, to replace the gas springs 38, the following operations may be applied to the pivotal connection parts at the upper ends of the gas springs 38.

With the unit body 37 fixed to the upper position by the lock mechanism above-mentioned, the upper ends of the gas springs 38 are inserted from the lateral openings of the notches 1114 to the insides thereof, and the connection plates 1115 having the pin holes 1116 are fitted to the pivot pins 41. Then, the securing means 1117 are inserted into the notches 1114 through the lateral openings thereof, and the pivot-pin coming-out prevention plates 1120 are fitted between the connection plates 1115 and the large-diameter head portions 1123 of the pivot pins 41 projecting through the pin holes 1116 of the connection plates 1115. Accordingly, the pivot-pin engagement grooves 1118 are engaged with the pivot pins 41, thus preventing the connection plates 1115 from coming out from the pivot pins 41. At this time, the securing means 1117 are fixed to the base 1125 with the fixing means 1119.

Since the notches 1114 are opened also in the front sides, the connecting operations can be carried out from the front side of the rolled-paper feed unit A. Further, there are used the securing means in which the pivot-pin coming-out prevention plates 1120, the lateral side cover portions 1121 and the underside cover portions 1122 are formed in a unitary structure. This facilitates the connection operation as compared with the case where extremely small coming-out prevention means such as E-rings are fitted from under.

When the securing means 1117 is fixed to the base 1125, the lateral openings of the notches 1114 are closed by the lateral side cover portions 1121 of the securing means 1117 and the excessive opening portions of the underside openings of the notches 1114 are closed by the underside cover portions 1122. This involves no likelihood that a finger tip of the operator of the rolled-paper feed unit A is caught by the pivotal connection parts of the upper ends of the gas springs 38.

The upper ends of the gas springs 38 thus connected may be disconnected by reversing the procedure above-mentioned. More specifically, the fixing means 1119 is removed and the securing means 1117 is pulled out forwardly so that the pivot-pin engagement grooves 1118 of the pivot-pin coming-out prevention plates 1120 come out from the pivot pins 41. Accordingly, the connection plates 1115, each having the pin hole 1116, at the upper ends of the gas springs 38 may be pulled out from the tips of the pivot pins 41. Then, the upper ends of the gas springs 38 are forwardly swung with the pivot pins 42 at the lower ends of the springs 38 serving as fulcra, so that the upper ends of the gas springs 38 may be pulled out outwardly through the lateral openings of the notches 1114.

In the embodiment shown in FIG. 7, each securing means 1117 is vertically symmetric such that the securing means 1117 having the same configuration is used for the left- and right-hand gas springs 38. However, there may be used dedicated securing means having no upper underside cover portion 1122.

In the embodiment, the pivot-pin coming-out prevention plates 1120 are engaged with the annular grooves 1124 formed in the pivot pins 41. However, when annular grooves are formed between the connection plates 1115 and the large-diameter head portions 1123 of the pivot pins 41, it is not required to form the annular grooves 1124 in the pivot pins 41.

It is merely required to dispose the gas springs 38 transversely symmetrically of the unit body 37. Accordingly, the gas springs 38 may be disposed such that the upper ends thereof are inclined toward the rear side of the rolled-paper feed unit A or such that the gas springs 38 are obliquely disposed so as to downwardly apart from each other when viewed from the front side of the rolled-paper feed unit A.

In a second embodiment of the present invention shown in FIGS. 8 to 13, FIG. 8 shows an electrostatic photographic copying apparatus which is an example of an image forming apparatus. In this embodiment, the main body 201 of the copying apparatus is mounted on a movable deck 202 and a rolled-paper feed unit A is connected to the copying apparatus main body 201 through a connecting member 205 for cutting rolled paper 203 into a cut sheet having a predetermined length and for feeding the cut sheet to a manual paper feed port 204 of the copying apparatus main body 201.

The following description will discuss the arrangement of the copying apparatus main body 201.

Reciprocating means 208 is disposed at the upper portion of an apparatus casing 206 for moving document with respect to an exposure device 207. Disposed at the lower portion of the apparatus casing 206 is a large-size paper feed cassette 209 which may be pulled out toward the rolled-paper feed unit A. A photoreceptor 210 is transversely disposed inside of the apparatus casing 206. Disposed around the photoreceptor 210 are a charging device 211, the exposure device 207, a developing device 212, a transferring device 213, a paper separating device 214 and a cleaning device 215. A pair of paper discharge rollers 223 are disposed above the manual paper feed port 204.

A paper delivery guide 217 extends from the feed port of the paper feed cassette 209 to the manual paper feed port 204, and a paper delivery passage 218 extends from the manual paper feed port 204 to the transferring device 213. A paper delivery passage 222 is formed for delivering the cut paper to a fixing device 221 after image transfer and paper separation, The rolled-paper feed unit A comprises a unit frame 235 to be mounted on the copying apparatus main body 201 at the side of the manual paper feed port 204 through the connecting member 205, and a unit body 237 vertically movable with respect to the unit frame 235. The unit frame 235 includes a bottom frame 230, vertical frames 233 respectively standing from both lateral sides of the bottom frame 230, and guide rails 234 at the front and rear sides of the vertical frames 233. Caster wheels 232 are threadedly connected, through screw shafts 231, to the four corners of the underside of the bottom frame 230. Thus, the unit frame 235 is movable and adjustable in horizontal level.

Figure 9:
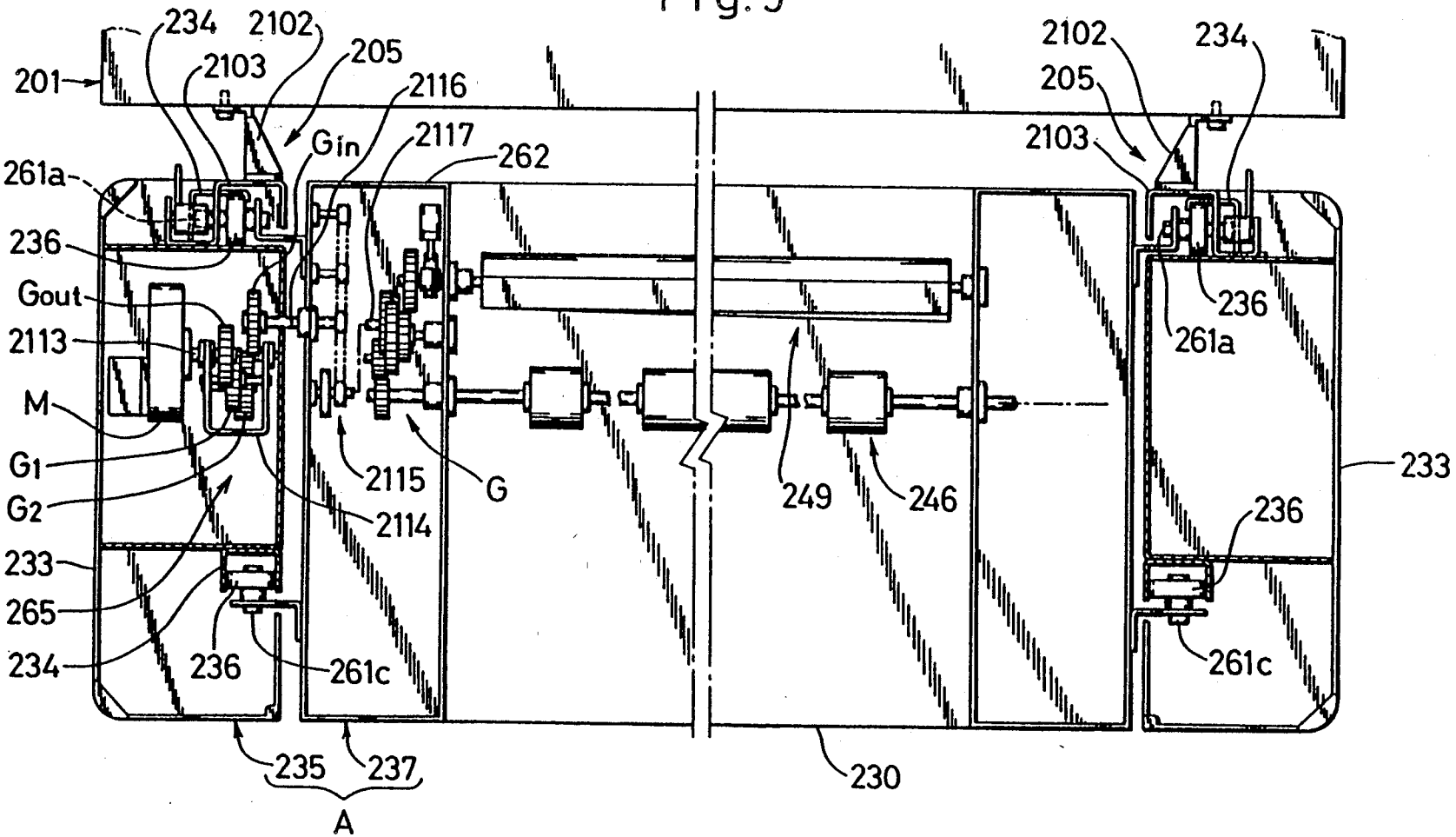
FIG. 9 is a transverse section view of the third embodiment in FIG. 8.
Figure 10:
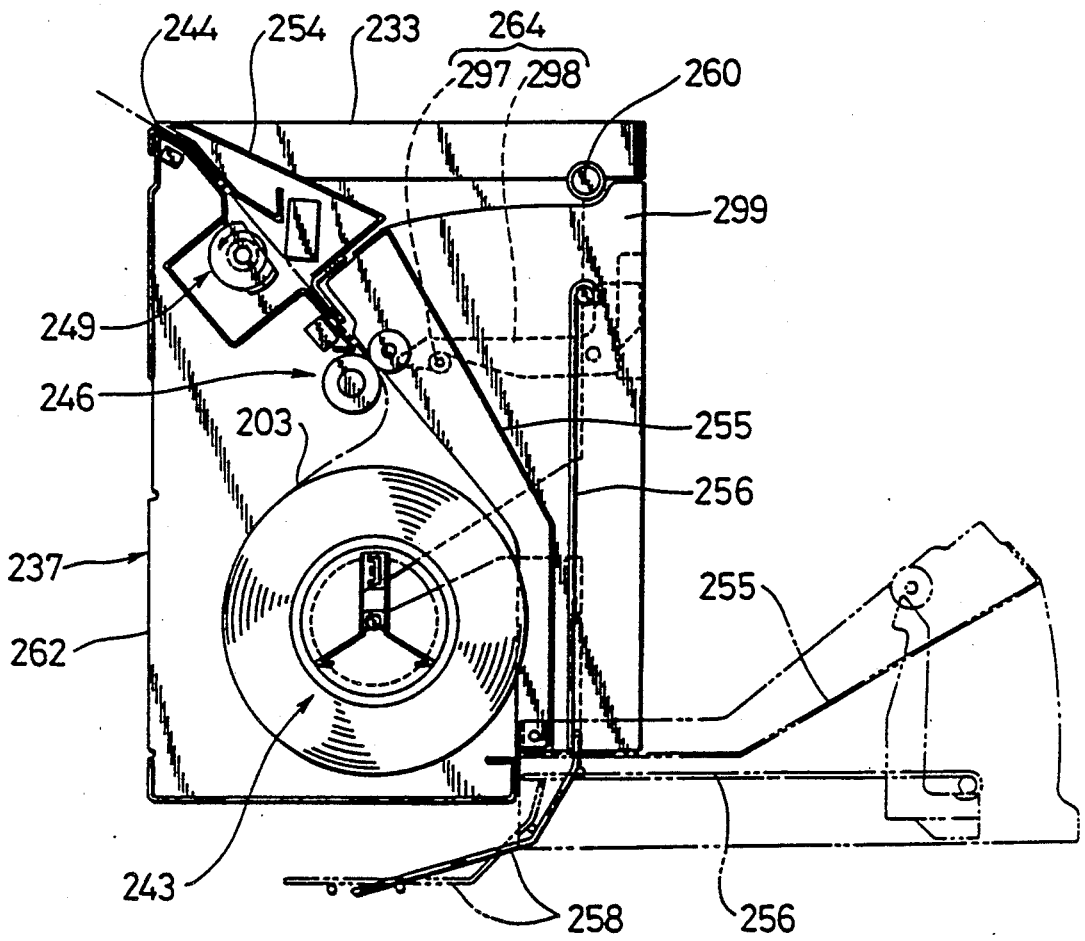
FIG. 10 is a vertical section view of the paper feed movable body in the third embodiment in FIG. 8.
Figure 11:
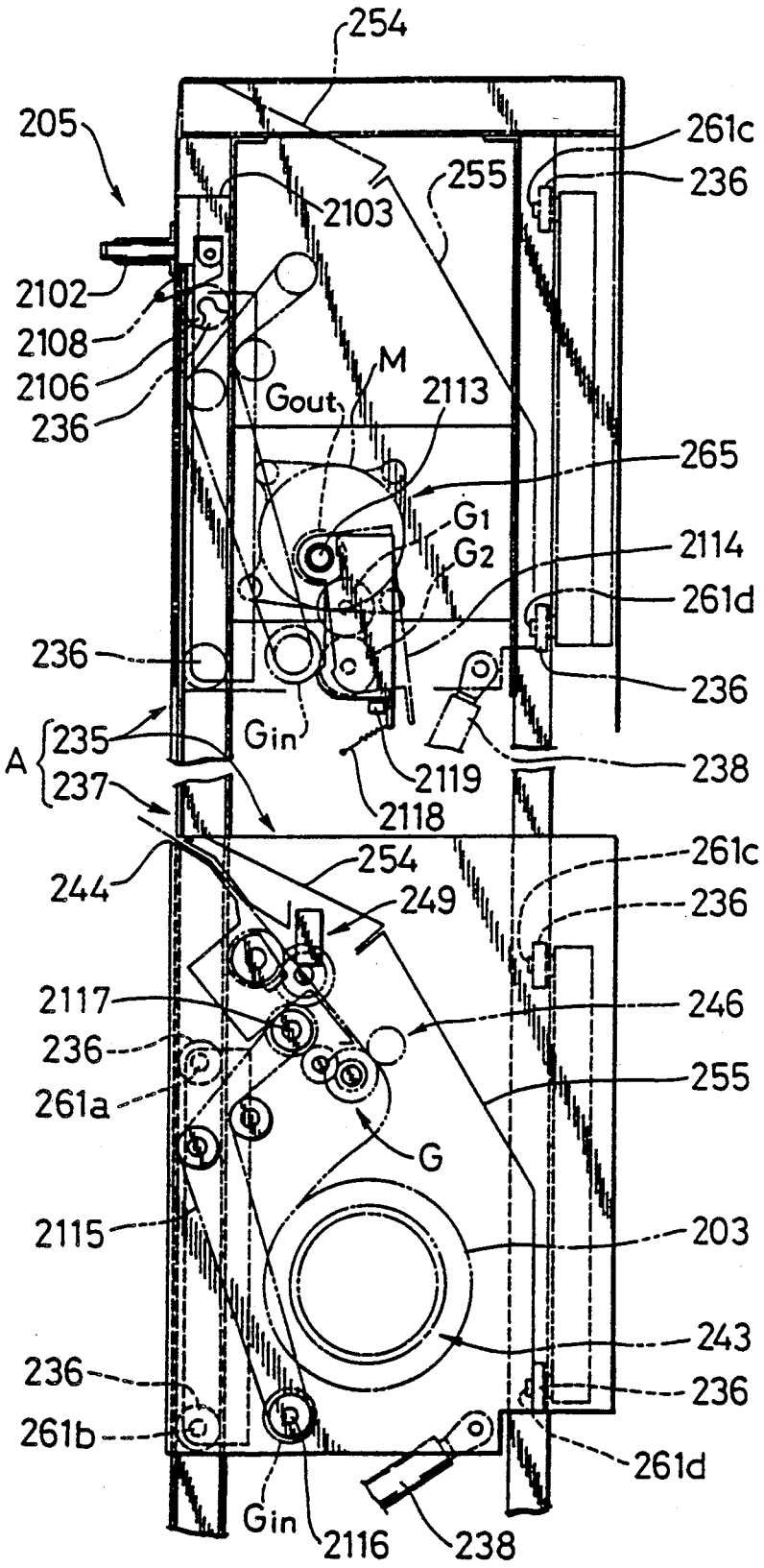
FIG. 11 is a vertical section view of the third embodiment in FIG. 8.
Figure 12:
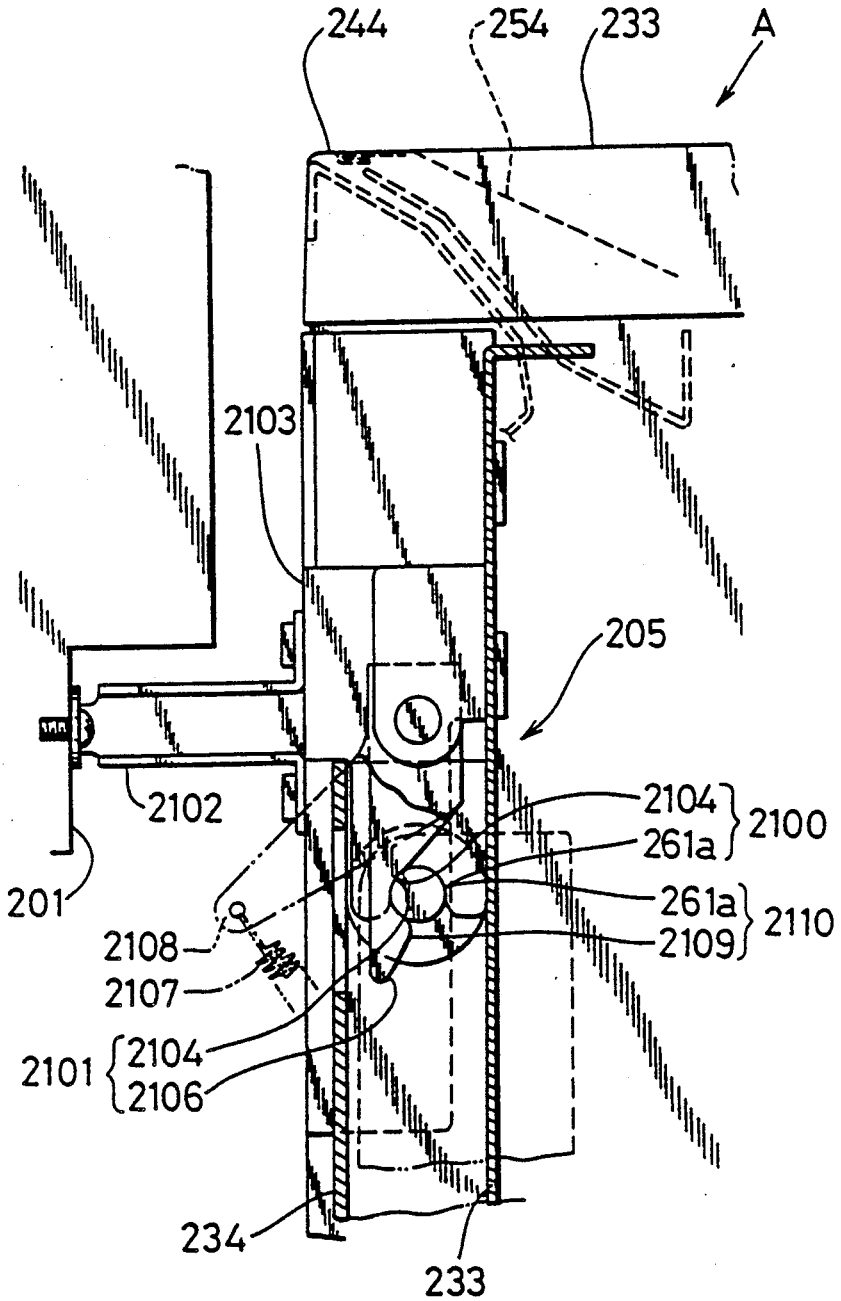
FIG. 12 is a side view of the connecting member used in the third embodiment in FIG. 8.

As shown in FIGS. 9 to 11, the unit body 237 has rollers 236 rotatable along the guide rails 234. The rollers 236 are disposed in the vicinity of the upper and lower corners of a vertically movable frame 262 through support shafts **261*a*, 261*b*, 261*c*, 261*d* serving as position-regulated members. As biasing means for pushing up and biasing the vertically movable frame 262, gas springs 238 (FIG. 8) are disposed at both lateral sides of the unit body 237 between the unit frame 235** and the vertically movable frame 262. A rolled-paper 203 mounting portion 243 is disposed in the lower portion of the vertically movable frame 262. A pair of paper feed rollers 246 as rolled-paper feed means and a rolled-paper cutting means 249 for cutting the rolled paper 203 into a cut sheet having a predetermined length, are disposed in a paper passage extending from the paper feed portion at the upper part of the rolled-paper mounting portion 243 to a paper discharge port 244 of the manual paper feed port 204. A tie-rod 260 is fixed, at both ends thereof, to the upper portion of the front side of the vertically movable frame 262.

In FIG. 9, the axes of the support shafts 261*a*, 261*b* of the total four upper and lower rollers 236 facing to the copying apparatus main body 201 are turned transversely of the rolled-paper feed unit A, thereby to prevent the rolled-paper feed unit A from being swung in the fonrt-to-back direction of the copying machine main body 201. The axes of the support shafts 261*c*, 261*d* of the four upper and lower rollers 236 apart from the copying apparatus main body 201 are turned in the front-to-back direction of the rolled-paper feed unit A, thereby to prevent the rolled-paper feed unit A from being swung transversely of the copying apapratus main body 201.

Referring to FIG. 10, a paper discharge guide plate 254 is obliquely disposed above the rolled-paper cutting means 249, and a cover 255 is openably attached to the front side of the rolled-paper feed unit A. The cover 255 covers the rolled-paper mounting portion 243 and serves also as a paper discharge/guide surface. There are also disposed a guide plate 256 for forming a paper discharge passage together with the cover 255, and a guide member 258 for guiding the cut paper discharged through this paper discharge passage.

There is disposed a bent guide member 229 for guiding paper to a bottom tray 259 of the unit frame 235. Cover fixing means 264 includes a stop pin 297 attached to the vertically movable frame 262, and a hook member 298 engageable with the stop pin 297, the hook member 298 being pivoted to a plate portion 299 connected to both sides of the cover 255.

According to the arrangement above-mentioned, (i) cut-paper fed from the paper feed cassette 209, (ii) cut-paper manually fed through the manual paper feed port 204 or (iii) a paper sheet cut, at predetermined timing, from the rolled paper 203 reeled out from the rolled-paper feed unit A and fed to the manual paper feed port 204, is passed, after image forming, through the paper discharge rollers 223 and then discharged toward the rolled-paper feed unit A. While being guided by the paper discharge/guide plate 254 and the cover 255, the cut paper reaches the guide member 258 between the cover 255 and the guide plate 256. The guide member 258 causes the cut paper to be changed in passage direction toward the movable deck 202. The tip of the cut paper comes in contact with the bent portions of the bent guide member 229, and the rear end of the cut paper comes out and falls from the guide member 258. Thus, the cut paper is guided to the bent guide member 229 and the tray 259.

Figure 13:
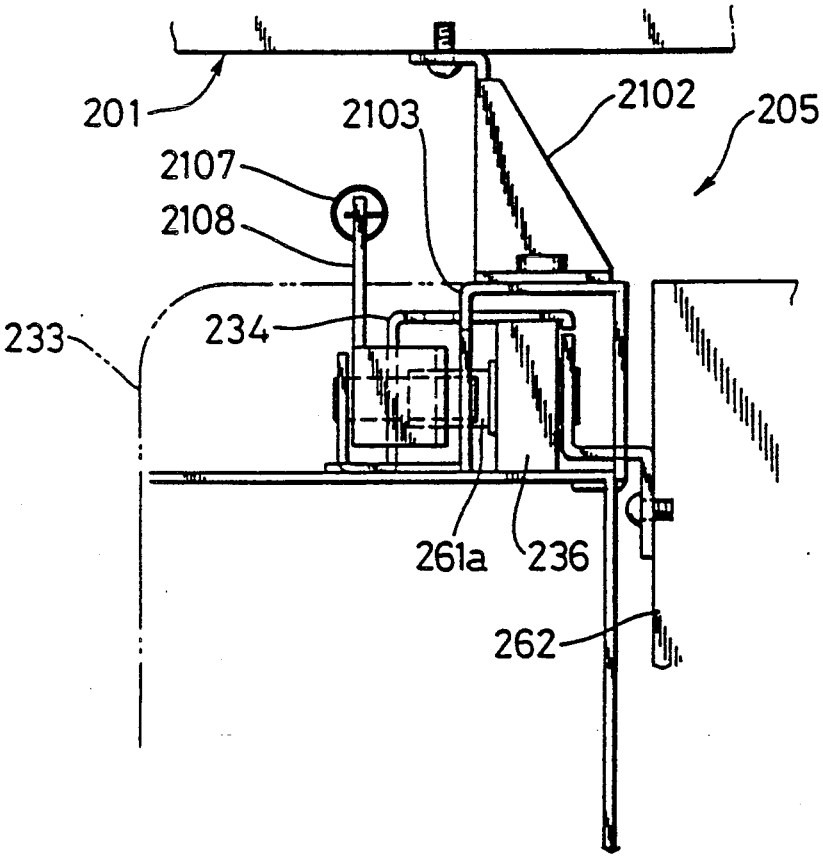
FIG. 13 is a plan view of the connecting member in the third embodiment in FIG. 8.
Figure 14:
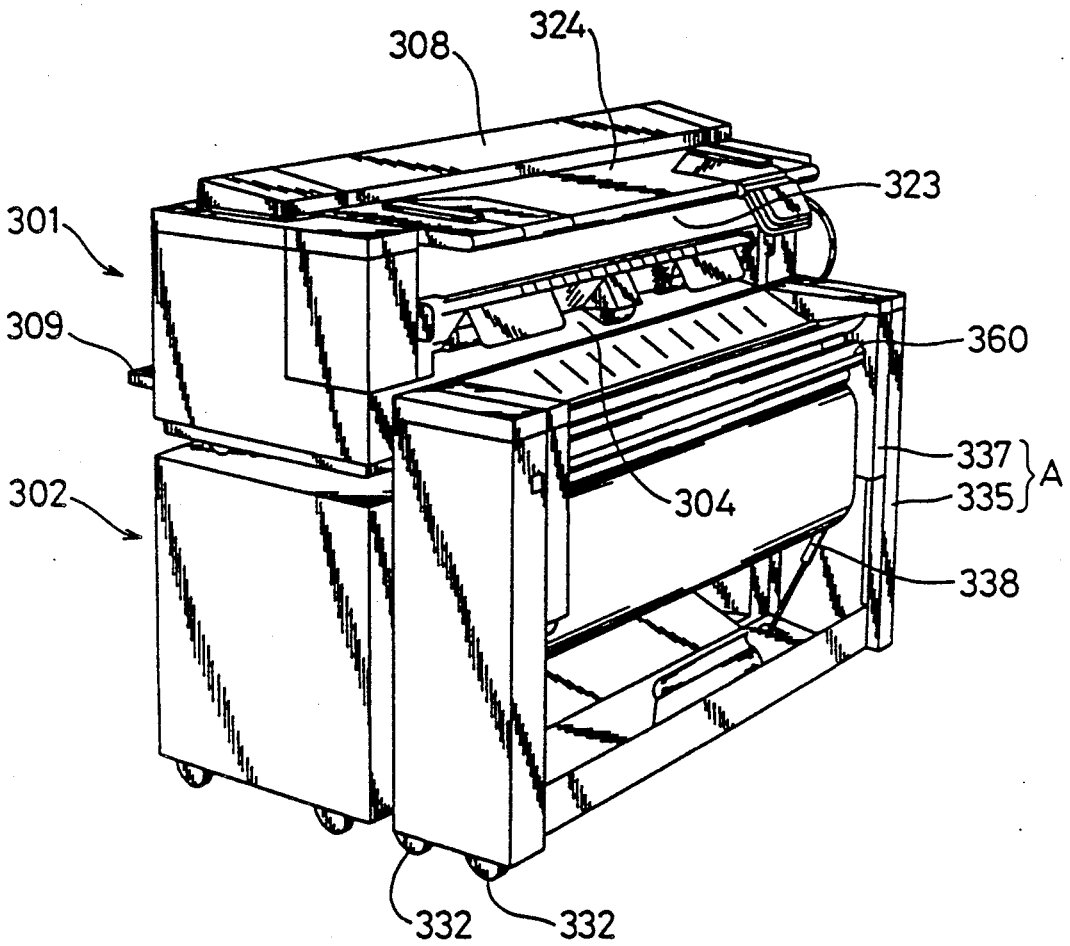
FIG. 14 is a perspective view of an image forming apparatus in accordance with a fourth embodiment of the present invention.

Referring to FIGS. 11 and 13, the description will discuss the specific arrangement of the connecting member 205 in this third embodiment.

The connecting member 205 includes position regulating means 2100 for regulating the vertical movement of the unit body 237 with respect to the unit frame 235, and fixing means 2101 for fixing the unit body 237 of which upward movement is being regulated, to the unit frame 235.

More specifically, each position regulating member 2103 in an S-shaped in plan elevation has connecting means 2102 to be connected to the copying apparatus main body 201. The position regulating members 2103 are disposed, as connected to the upper portions of the guide rails 234 at the side of the copying apparatus main body 201, at the vertical frames 233. The support shaft 261*a* of the upper rollers 236 of the unit body 237 serves as a position-regulated member, and is adapted to be engaged, from under, with concave portions 2104 of the position regulating members 2103. With the paper discharge port 244 of the unit body 237 facing the manual paper feed port 204 of the copying apparatus main body 201, the support shaft 261*a* is so regulated in position as to be engaged with the concave portions 2104. There is thus formed the position regulating means 2100 for regulating the upward movement of the unit body 237 with respect to the unit frame 235.

The fixing means 2101 includes the concave portions 2104 and hook members 2106 for holding the support shaft 261*a* engaged with the concave portions 2104. The hook members 2106 are pivoted to the position regulating members 2103. Biasing means 2107 for biasing and holding the hook members 2106 at a retention position is disposed between the position regulating members 2103 and arms 2108 connected to the hook members 2106.

The tip of each hook member 2106 with which the support shaft 261*a* is adapted to come in contact with the vertical movement of the unit body 237, is made in the form of an inclined cam surface 2109. The cam surface 2109 and the support shaft 261*a* form a cam mechanism 2110 for switching the hook member 2106 to a retention release position against the biasing force of the biasing means 2107 with the vertical movement of the unit body 237.

Accordingly, when the unit body 237 is moved up, the support shaft 261*a* comes in contact with the cam surfaces 2109 at the tips of the hook members 2106. Then, the hook members 2106 are once switched to the retention release position, and the support shaft 261*a* is fitted in the concave portions 2104 of the position regulating members 2103 so that the support shaft 261*a* is regulated in upward movement. Further, the hook members 2106 are switched to the retention position, so that the support shaft 261*a* of which upward movement is being regulated, is fixed by the concave portions 2104 and the hook members 2106.

In the state above-mentioned, the caster wheels 232 are threadedly moved to adjust the horizontal level of the rolled-paper feed unit A such that the axes of the various rollers in the rolled-paper feed unit A are parallel with the axes of the various rollers in the copying apparatus main body 201. Further, the unit frame 235 is temporarily connected to the copying apparatus main body 201 through the connecting means 2102. Then, a test operation of paper feed is carried out. If the rolled paper 203 is obliquely fed or cut, the caster wheels 232 are threadedly fine-adjusted to enhance the parallelisms of the roller axes. It is then made sure that the rolled paper 203 is properly fed and cut. Then, the unit frame 235 is finally connected to the copying apparatus main body 201.

As far as the rolled-paper feed unit A is connected to the copying apparatus main body 201 in this manner, no problems will be caused thereafter. More specifically, even though the unit body 237 is lowered in order to carry out maintenance such as a jam processing or paper resupply to the paper feed cassette 209, the unit body 237 can be returned to the original paper feed position with the axes of the various rollers being parallel, when the unit body 237 is moved up and fixed as regulated in position. This securely prevents the rolled paper 203 from being obliquely fed and cut, as would be often done when paper feed is carried out after maintenance.

The following description will discuss drive means 265 disposed in the rolled-paper feed unit A with reference to FIGS. 9 and 11.

The drive means 265 includes a motor (as a drive source) M disposed in one vertical frame 233. A first gear G1 adapted to be meshed with an output gear Gout put on a motor shaft 2113 of the motor M, and a second gear G2 adapted to be meshed with the first gear G1, are rotatably disposed on a gear bracket 2114 pivoted to the motor shaft 2113.

Disposed in the unit body 237 is an input gear Gin adapted to be meshed with the second gear G2 when the unit body 237 is raised and the upward movement thereof is regulated by the position regulating members 2103. A belt-type transmission mechanism 2115 having an output shaft 2117 is interlocked with an input shaft 2116 of the input gear Gin. Meshed with the output shaft 2117 is a gear mechanism G interlocked with the paper feed rollers 246 and the rolled-paper cutting means 249.

A spring 2118 is disposed for biasing and swinging the gear bracket 2114 toward the copying apparatus main body 201 so that the second gear G2 is biased to and meshed with the input gear Gin of the unit body 237 which is located in the paper feed position. A stopper 2119 is disposed for preventing the gear bracket 2114 from being swung against the biasing force of the spring 2118. That is, the stopper 2119 is so disposed as to prevent the gear bracket 2114 from being swung with the second gear G2 slightly projecting into the locus of the vertical movement of the input gear Gin.

Accordingly, when the unit body 237 located in the paper feed position is lowered for the purpose of maintenance or the like, the input gear Gin is also lowered integrally with the unit body 237, thereby to release the engagement in a power transmission mechanism formed by the second gear G2 in the unit frame 235 and the input gear Gin in the unit body 237.

Accordingly, even though the switch is erroneously operated to start the motor M at the time of maintenance with the unit body 237 lowered, power transmission to the input gear Gin is interrupted. This prevents the paper feed rollers 246 and the rolled-paper cutting means 249 from being driven. This assures safe maintenance for jam processing or the like.

The position regulating means 2100 may also be formed by disposing, as the position regulating members 2103, the support shaft 261*a* in the embodiment above-mentioned at the side of the unit frame 235, and by disposing, as the support shaft 261*a*, the position regulating members 2103 at the side of the unit body 237. Further, the fixing means 2101 may be formed by disposing the hook members 2106 at the side of the unit body 237.

In a third embodiment of the present invention shown in FIGS. 14 to 19, FIG. 14 is a perspective view of an electrostatic photographic copying apparatus which is an example of an image forming apparatus of the present invention. This electrostatic photographic copying apparatus is so arranged as to copy a large-size document of A1 or A0 size. This copying apparatus incorporating a paper feed cassette 309 is provided at the front of the wide main body 301 thereof with a wide document insertion port 324, a paper insertion port 304 and a paper discharge port 323, and also provided at the top side thereof with wide document delivery means 308. A rolled-paper feed unit A is disposed at the front side of the copying apparatus main body 301.

Figure 15:
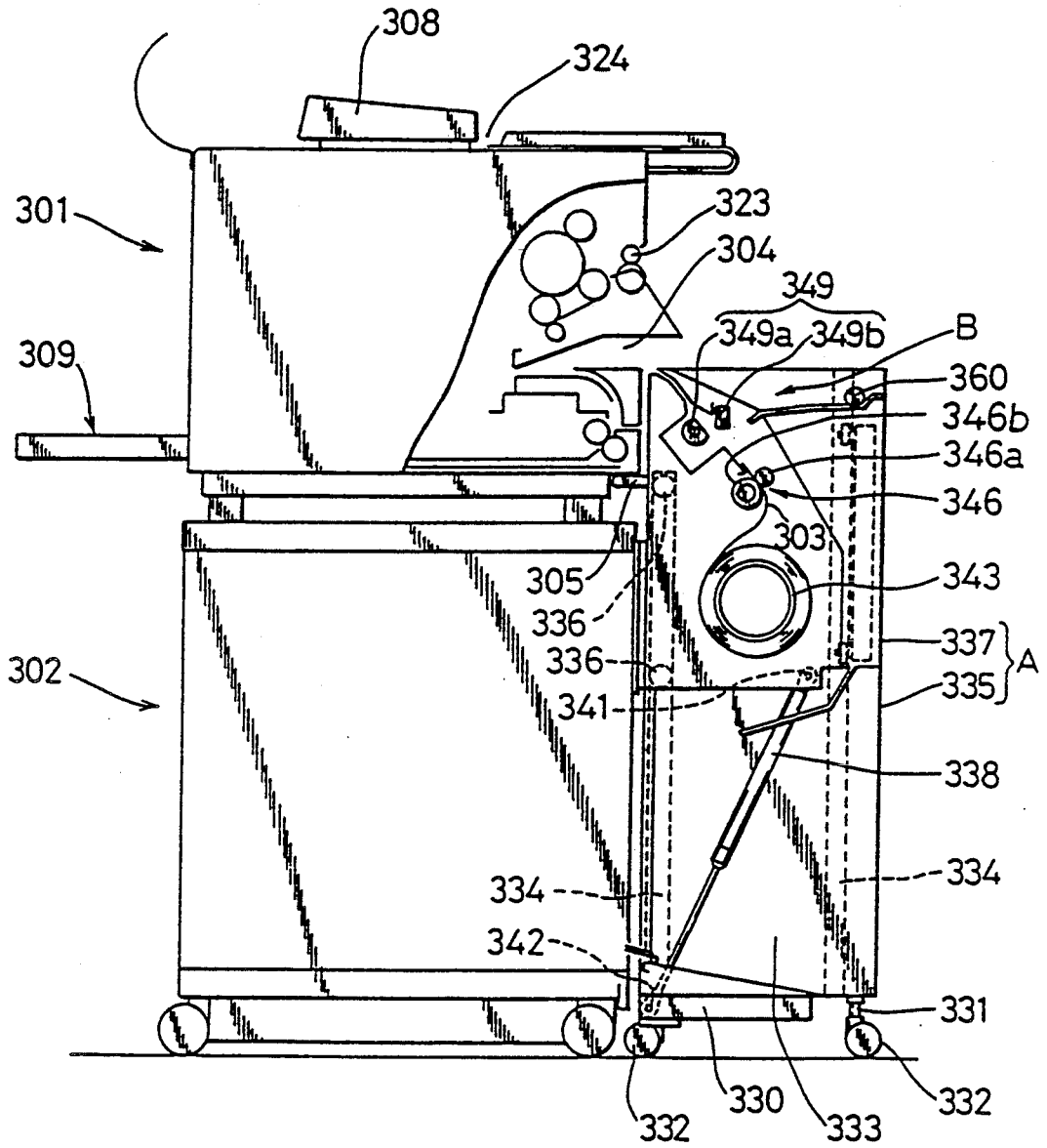
FIG. 15 is a schematic vertical section view of the image forming apparatus of the fourth embodiment in FIG. 14.

Referring also to FIG. 15, the rolled-paper feed unit A includes a stationary frame in the form of a unit frame 335 to be connected to the front side of the copying apparatus main body 301 through a connecting member 305, and a movable body in the form of a unit body 337 vertically movably supported by the unit frame 335.

The unit frame 335 includes a bottom frame 330, vertical frames 333 standing from both lateral sides of the bottom frame 330, guide rails 334 disposed at the front and rear sides of the vertical frames 333 and casters 332 disposed, through screw shafts 331, at the corners of the underside of the bottom frame 330.

Figure 16:
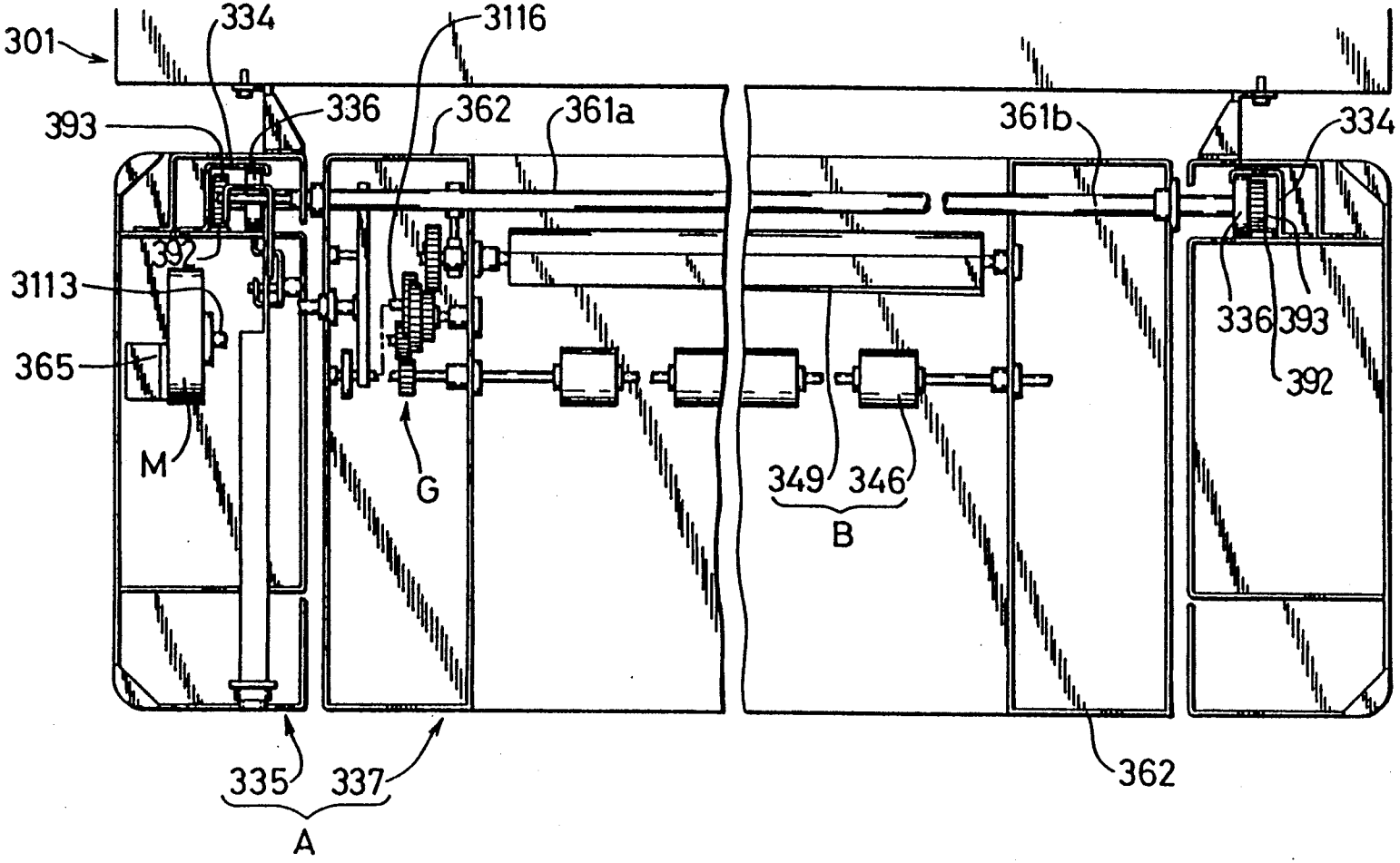
FIG. 16 is a transverse section view of the fourth embodiment in FIG. 14.
Figure 17:
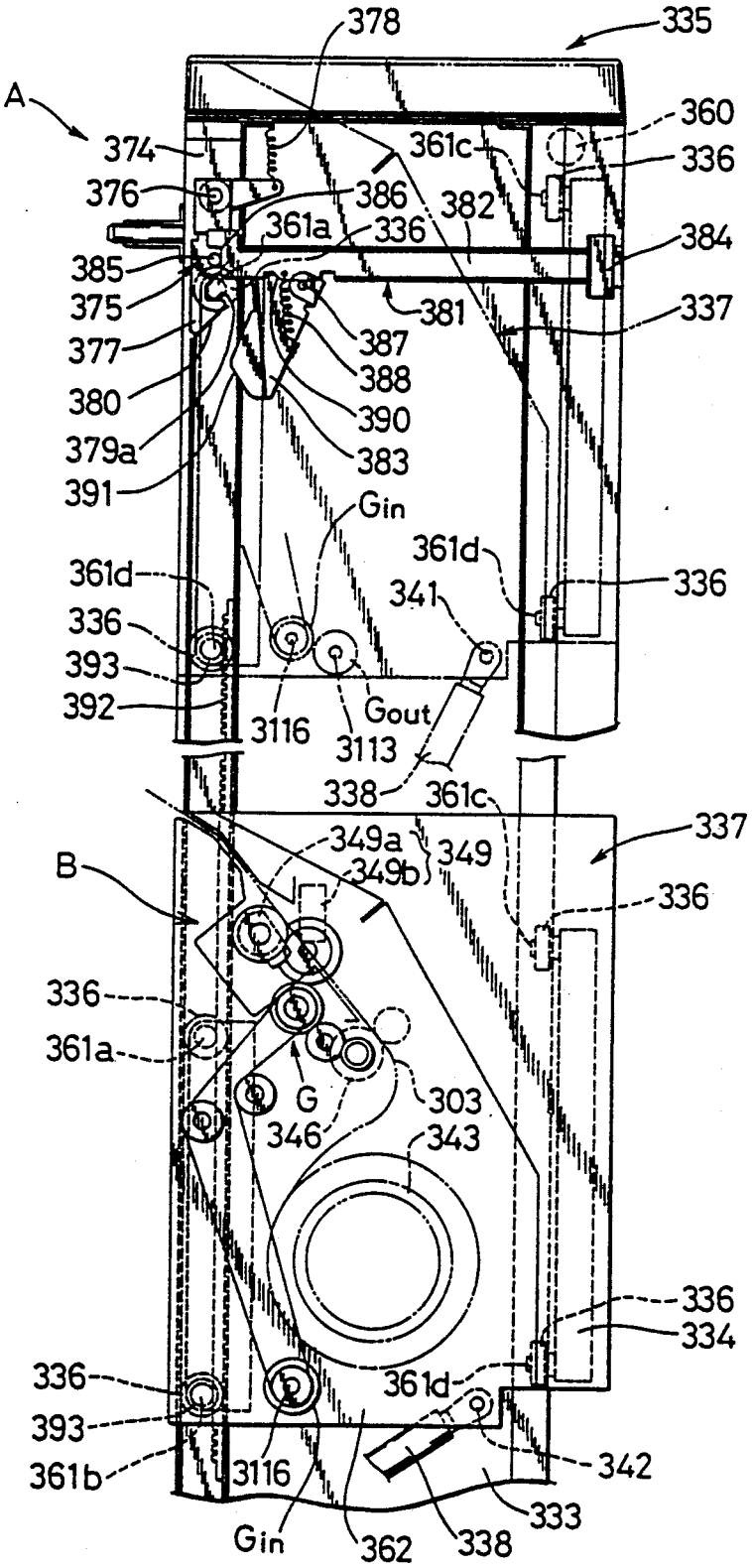
FIG. 17 is a vertical section view of the fourth embodiment in FIG. 14.

As shown in FIGS. 16 and 17, the unit body 337 has a vertically movable frame 362. Rollers 336 rotatably movable along the guide rails 334 of the unit frame 335 are respectively attached, through respective support shafts 361*a*, 361*b*, 361*c*361*d*, in the vicinity of upper and lower four corners of the vertically movable frame 362. Incidentally, FIG. 16 shows transversely different cross sections: left side thereof mainly shows the support shaft 361*a*; and right side thereof mainly shows support shaft 361*b*. The axes of the support shafts 361*a*, 361*b* at the back side are parallel, as passing through the vertically movable frame 362, with the axis of rolled paper 303, while the axes of the support shafts 361*c*361*d* at the front side are at right angles to the axis of the rolled paper 303. A tie-rod 360 serving as a handle is disposed at the front of the vertically movable frame 362 (See FIGS. 14, 15). When the tie-rod 360 is pulled toward the operator, the front side of the vertically movable frame 362 is opened so that the rolled paper 303 may be mounted. At the lateral sides of the lower portion of the vertically movable frame 362, a pair of fluid sealing dampers 338 are rotatably disposed through pivot pins 341 for upwardly biasing the unit body 337. The lower ends of the fluid sealing dampers 338 are rotatably connected to the bottom frame 330 of the unit frame 335 through pivot pins 342. A rolled-paper 303 mounting portion 343 is disposed in the unit body 337. Disposed above the rolled-paper mounting portion 343 are paper feed means 346 for reeling out and feeding the rolled paper 303 and a rolled-paper cutting means 349 for cutting the rolled paper 303 into a sheet having a predetermined length. Thus, the paper feed means 346 and the cutting means 349 form rolled-paper cutting mechanism B.

The paper feed means 346 is so arranged as to reel out the rolled paper 303 as held by and between a pair of rollers 346*a*, 346*b*. The cutting means 349 is so arranged as to cut the rolled paper 303 by a rotary blade 349*a* and a stationary blade 349*b*.

As shown in FIG. 17, drive means 365 having motor M (See FIG. 16) as a drive source is disposed in the vertical frames 333 of the unit frame 335. The drive force from the drive means 365 is adapted to be transmitted to a gear mechanism G disposed in the unit body 337. The drive force from the drive means 365 is adapted to be transmitted by the engagement of an output gear Gout put on an output shaft 3113 of the drive means 365 with an input gear Gin put on an input shaft 3116 of the gear mechanism G. The output gear Gout and the input gear Gin are disengaged when the unit body 337 is moved downward, and are engaged again when the unit body 337 is moved upward.

Figure 18:
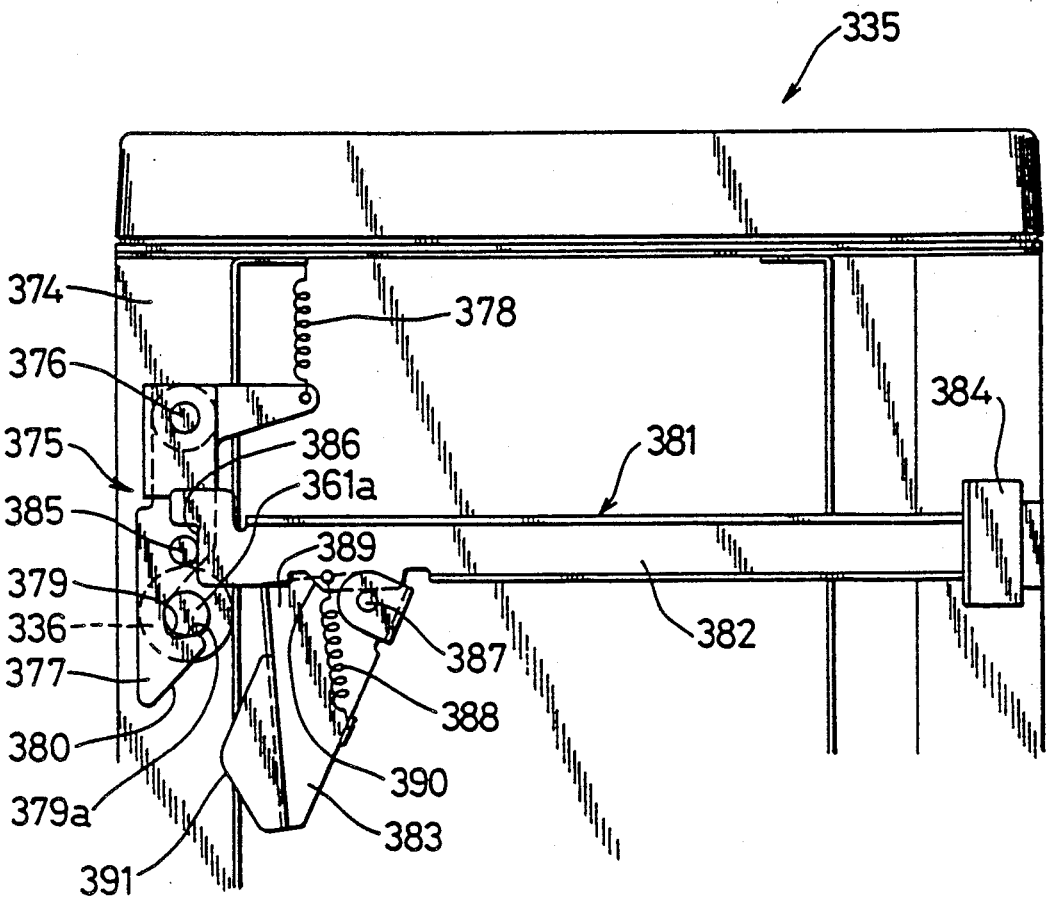
FIG. 18 is an enlarged section view of main portions of lock means and lock releasing means in the fourth embodiment in FIG. 14.
Figure 19:
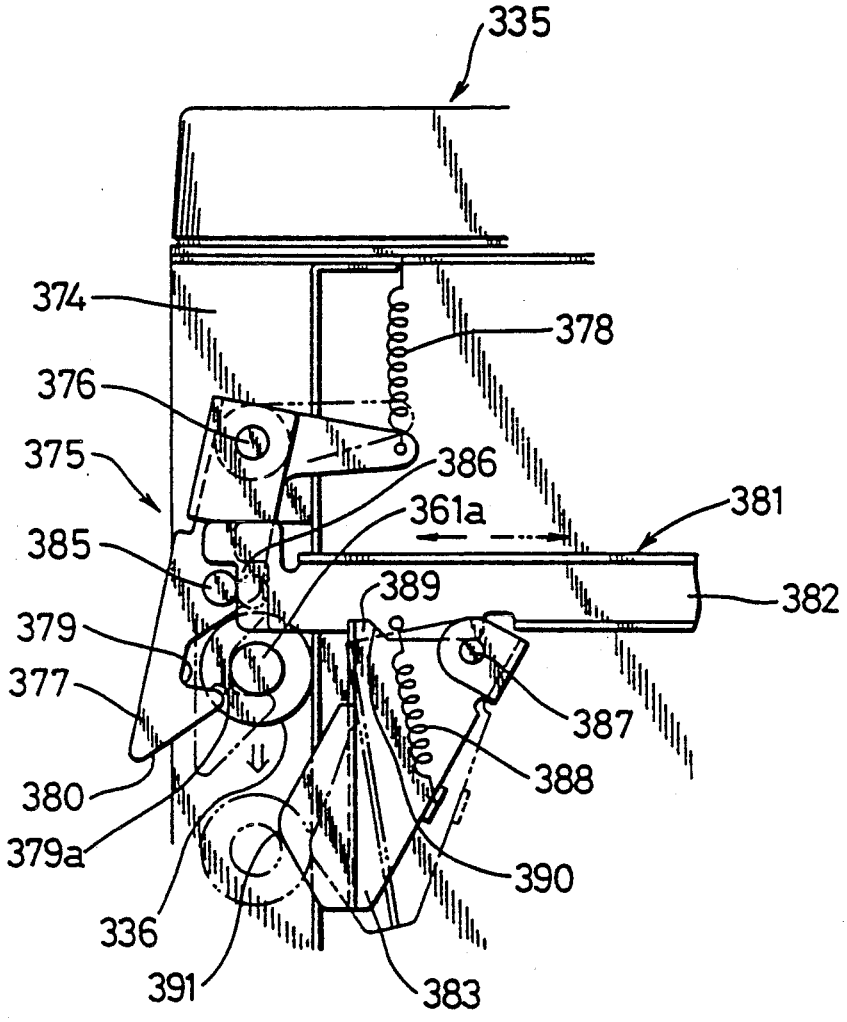
FIG. 19 is an enlarged section view of main portions of the lock means and the lock releasing means in the fourth embodiment in FIG. 14.

Referring to FIGS. 17 to 19, the upper position of the unit body 337 is regulated by a position regulating member 374 disposed at the unit frame 335. The downward movement of the unit body 337 is regulated by lock means 375 disposed in the vicinity of the position regulating member 374. The lock means 375 is disposed at the left- or right-hand vertical frame 333 of the unit frame 335. The lock means 375 has a hook member 377 supported rotatably around a support shaft 376 with respect to the unit frame 335, and a coil spring 378 for rotatably biasing the hook member 377 normally counterclockwise in FIGS. 18 and 19. Formed in the vicinity of the lower end of the hook member 377 is an engagement groove 379 adapted to be engaged with the support shaft 361*a* which supports the rollers 336 at the upper back side of the unit body 337. Formed at the lower end of the hook member 377 is a tapering portion 380 adapted to come in contact with the support shaft 361*a* at the time of upward movement of the unit body 337, so that the hook member 377 is rotated against the biasing force of the coil spring 378, thereby to automatically engage the engagement groove 379 with the support shaft 361*a*. The engagement groove 379 of the hook member 377 has a horizontal receiving part 379*a* adapted to come in contact with the underside of the support shaft 361*a* in order to hold the unit body 337 at the upper position against a pushing force applied at the time when the unit body 337 is pushed down.

Disposed in the unit frame 335 is lock release means 381 for releasing the lock state of the unit body 337 provided by the lock means 375. The lock release means 381 has a pushing member 382 for pushing and rotating the hook member 377 of the lock means 375 against the biasing force of the coil spring 378, and a stopper 383 for maintaining the hook member 377 as pushed by the pushing member 382. The pushing member 382 is provided at one end thereof with an operation button 384 exposed to the front side of the unit frame 335, and at the other end thereof with a contact portion 386 coming in contact with a pin 385 which projects at the lateral side of the hook member 377.

The stopper 383 is supported rotatably around the support shaft 387 with respect to the unit frame 335, and is so biased as to be normally rotated clockwise in FIG. 18 by a coil spring 388 disposed between the stopper 383 and the pushing member 382. With the hook member 377 engaged with the support shaft 361*a*, an engagement portion 389 of the stopper 383 at the upper end corner thereof is pushed down by the underside of the pushing member 382. This causes the engagement portion 389 to be rotated counterclockwise (See FIG. 18). Formed at the underside of the pushing member 382 is a concave portion 390 adapted to be engaged with the engagement portion 389 of the stopper 383. The concave portion 390 is adapted to be engaged with the engagement portion 389 when the pushing member 382 is pushed so that the hook member 377 is disengaged from the support shaft 361*a* of the roller 336 (See FIG. 19). A cam surface 391 is formed at the stopper 383. Immediately after the unit body 337 located in the upper position has been pushed down, the cam surface 391 is adapted to come in contact with the roller 336 to rotate the stopper 383 against the coil spring 388, thereby to forcibly disengage the engagement portion 389 of the stopper 383 from the concave portion 390 of the pushing member 382.

As shown in FIGS. 16 and 17, vertically extending racks 392 are disposed at both lateral sides of the unit frame 335 at the rear side thereof. Pinions 393 engaged with the racks 392 are disposed at the lower parts of the both lateral sides of the unit body 337. To support the rollers 336 at the lower back side, the pinions 393 are integrally rotatably attached to both ends of the support shaft 361*b* so inserted in the vertically movable frame 362 as to be parallel with the axis of the rolled paper 303. Accordingly, the racks 392 and the pinions 393 make it possible to equalize the amounts of vertical movement of the unit body 337 at both lateral sides thereof at the time when the unit body 337 is vertically moved. This prevents the unit body 337 from being transversely inclined.

According to the rolled-paper feed unit A having the arrangement above-mentioned, the lock means 375 itself holds the unit body 337 at the upper position against the downward pushing force of the unit body 337. Accordingly, there is no possiblity of the unit body 337 being accidentaly pushed down. This involves no likelihood that the drive force for the gear mechanism G of the unit body 337 is interrupted in the course of discharging the rolled paper 303, thereby to prevent the cutting means 349 from cutting the rolled paper 303.

To lower the unit body 337 for attachment or removal of the paper feed cassette 309, the pushing member 382 of the lock release means 381 may be pushed through the operation button 384 attached at one end thereof. This causes the hook member 377 of the lock means 375 to be rotated clockwise against the biasing force of the coil spring 378, so that the lock state of the unit body 337 provided by the lock means 375 is released (See FIG. 19). In this lock release state, the concave portion 390 of the pushing member 382 is engaged with the engagement portion 389 of the stopper 383, thereby to restrain the pushing member 382 from being pushed back in the right direction in FIG. 20. Accordingly, even though the operation button 384 of the pushing member 382 is released from the operator's hand, the lock release state above-mentioned may be maintained. Immediately after the unit body 337 has been pushed down, the roller 336 comes in contact with the cam surface 391 of the stopper 383, causing the stopper 383 to be rotated counterclockwise against the biasing force of the coil spring 388. This disengages the pushing member 382 from the stopper 383, causing the pushing member 382 to be returned in the right direction in FIG. 19.

The stopper 383 may be eliminated. In this case, the unit body 337 may be pushed down with one hand, while the operation button 384 of the pushing member 382 is pushed with the other hand. At this time, the racks 392 and the pinions 393 prevent the unit body 337 from being transversely inclined. Thus, the unit body 337 may be smoothly pushed down even with both hands. However, when the stopper 383 is disposed, the unit body 337 may be pushed down with one hand. Thus, the racks 392 and the pinions 393 are not necessarily disposed.

In the embodiment above-mentioned, various designing modification may be made. For example, the pushing member 382 may be pushed by a rotary lever serving as the lock release means 381, or the pinions 393 may be disposed at the side of the unit frame 335, while the racks 392 may the disposed at the side of the unit body 337.

Figure 20:
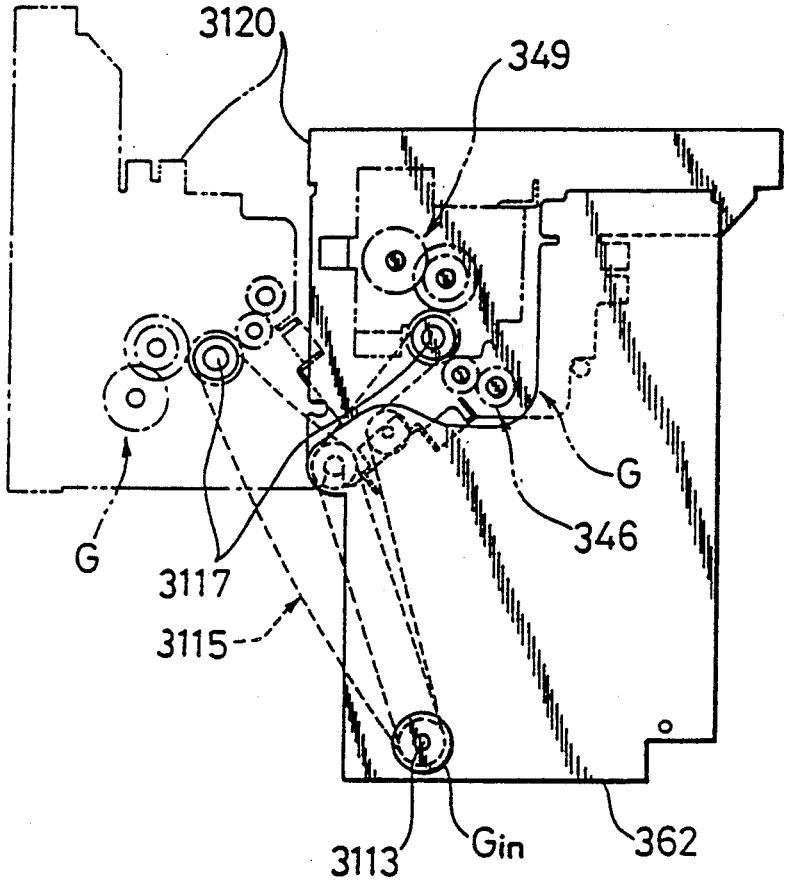
FIG. 20 is a view illustrating the swing movement of a swing bracket having rolled-paper cutting means and the like view of the fourth embodiment in FIG. 14.
Figure 21:
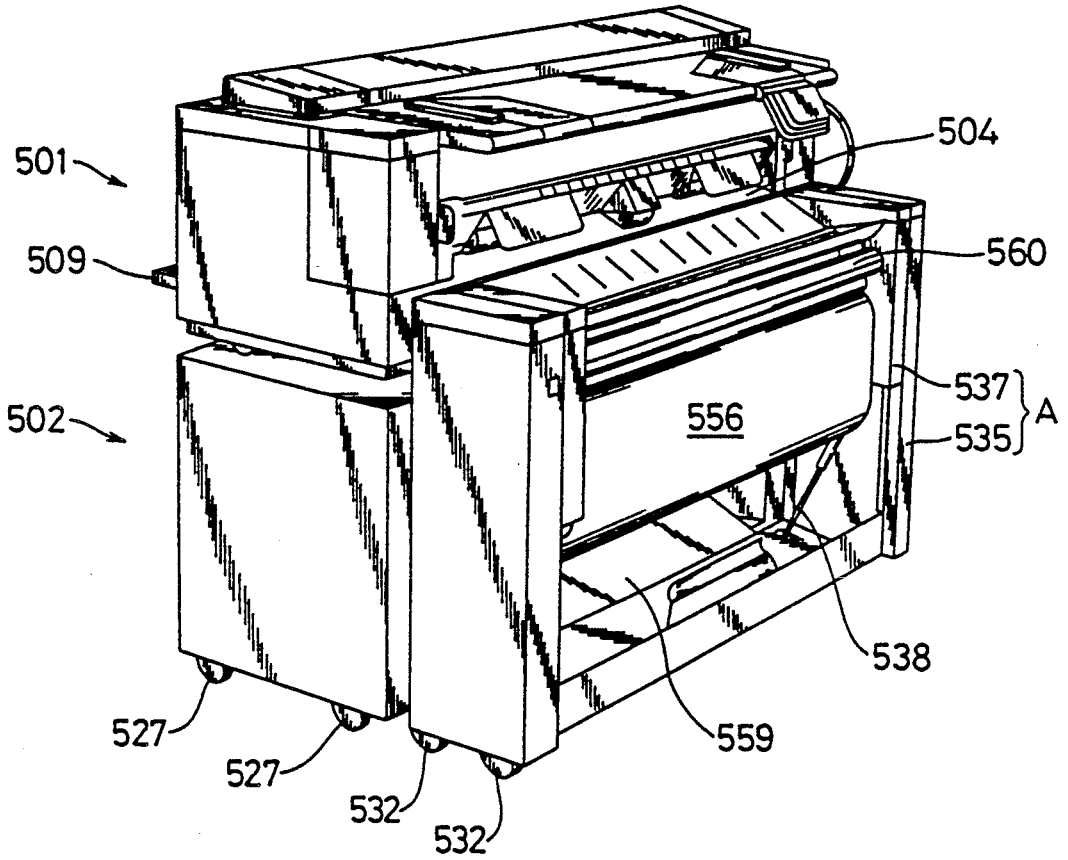
FIG. 21 is a schematic perspective view of an image forming apparatus in accordance with a sixth embodiment of the present invention.

When the motor M for the drive system of the unit body 337 is disposed at the side of the unit frame 335 as above-mentioned, the motor M and the gears may get in the way, thereby to make it difficult to maintain the drive system of the unit body 337. To overcome such a problem, as shown in FIG. 20 the paper feed rollers 346 and the rolled-paper cutting mechanism 349 are attached to a swingable bracket 3120, which is pivoted to the vertically movable frame 462 such that the swingable bracket 3120 is swung toward the copying apparatus main body 301. The swingable bracket 3120 is fixed, as initially positioned, to the vertically movable frame 362 with screws (not shown).

Accordingly, the swingable bracket 3120 may be swung, as necessary, toward the copying apparatus main body 301. This facilitates the maintenance of the paper feed rollers 346 and the rolled-paper cutting mechanism 349.

FIGS. 22 to 25 show a fifth embodiment of the present invention, in which the main body 501 of a copying apparatus as an image forming apparatus is mounted on a movable deck 502 and a rolled-paper feed unit A is connected to the copying apparatus main body 401.

Figure 22:
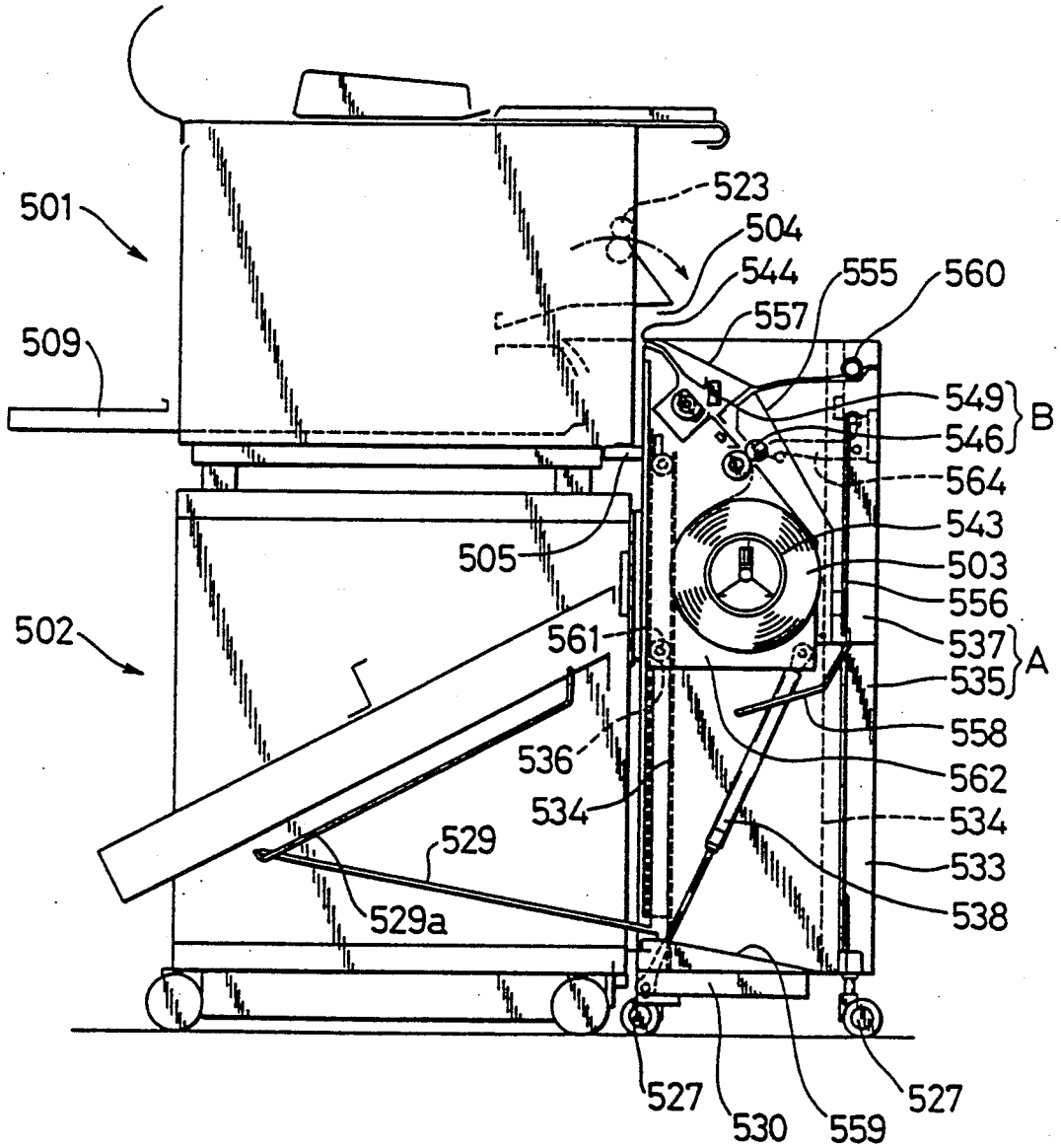
FIG. 22 is a schematic vertical section view of the image forming apparatus of the fifth embodiment in FIG. 21.

Refering to FIG. 22, the copying apparatus main body 501 is provided at the lower portion of one lateral side thereof with a paper feed cassette 509 which may be pulled out toward the operator, and at the other lateral side thereof with a manual paper feed port 504.

The rolled-paper feed unit A includes a unit frame 535 to be mounted on the copying apparatus main body 501 at the side of the manual paper feed port 504 through a connecting member 505, and a unit body 537 which is vertically movable from an upper position (FIG. 24) to a lowered retreat position (FIG. 25) with both ends thereof held by the unit frame 535.

The unit frame 535 has a bottom frame 530, vertical frames 533 standing from both lateral sides of the bottom frame 530, guide rails 534 at the front and rear sides of the vertical frames 533, and casters 527 at the four corners of the underside of the bottom frame 530.

The unit body 537 has rollers 536 rotatable along the guide rails 534 at the side of the movable deck 502, the rollers 536 being disposed in the vicinity of the upper and lower four corners of a vertically movable frame 562 through support shafts 561. Biasing means for pushing up and biasing the vertically movable frame 562 (for example, gas springs) are disposed at both lateral sides of the unit body 537 between the unit frame 535 and the vertically movable frame 562. A rolled-paper 503 mounting portion 543 is disposed at the lower portion of the vertically movable frame 562. A pair of paper feed rollers 546 as rolled-paper feed means and a rolled-paper cutting means 549 for cutting the rolled paper 503 into a cut sheet having a predetermined length, are disposed in a paper passage extending from the paper feed portion at the upper part of the rolled-paper mounting portion 543 to a paper discharge part 544 of the manual paper feed port 504. The paper feed rollers 546 and the rolled-paper cutting means 549 form rolled-paper cutting mechanism B. A tie-rod 560 is fixed, at both ends thereof, to the upper portion of the front side of the vertically movable frame 562.

A paper discharge/guide plate 557 is obliquely disposed above the rolled-paper cutting means 549. As covering the rolled-paper mounting portion 543, a cover 555 serving also as a paper discharge/guide surface is openably attached. There are also disposed a guide plate 556 for forming a paper discharge passage together with the cover 555, and a guide member 558 for guiding the cut paper discharged through the paper discharge passage toward the movable deck 502. In FIG. 22, cover fixing means is generally designated by a reference numeral 564.

Figure 23:
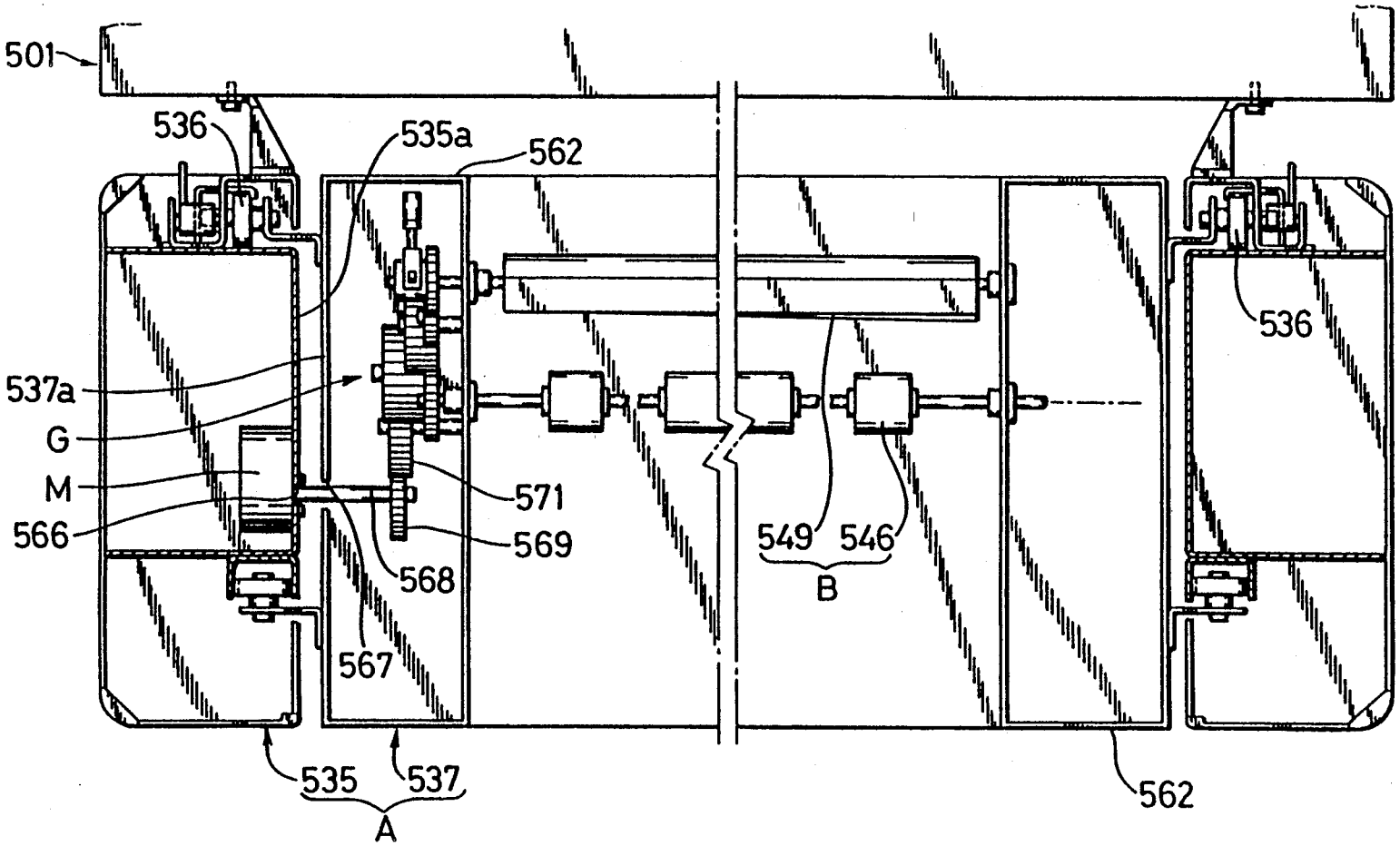
FIG. 23 is a transverse section view of the fifth embodiment in FIG. 21.

The following description will discuss drive means 565 of the rolled-paper cutting mechanism B with reference to FIG. 23.

Figure 24:
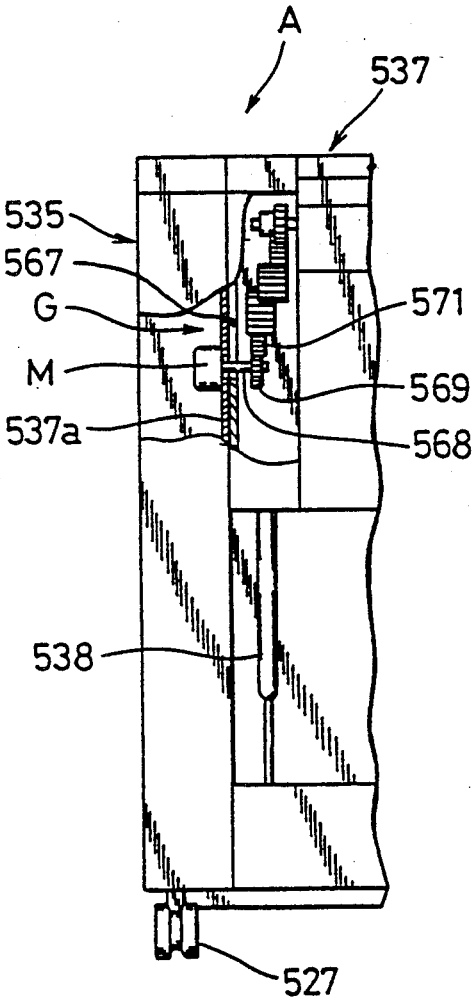
FIG. 24 is a schematic section view of the movable body located in an upper position in the fifth embodiment in FIG. 21.

The drive means 565 includes: a motor M, as a drive source, disposed in one vertical frame 533 of the unit frame 535; a drive transmission shaft in the form of an input shaft 568 connected directly to the motor M and introduced into the unit body 537 after having passed through an insertion hole 566 formed in an end surface **533*a* of the unit frame 535 and a vertically extending slot 567 formed in an end surface 537*a* of the unit body 537; a drive-side connecting gear 569 integrally rotatably attached to the introduced end of the input shaft 568; a gear mechanism G attached to the unit body 5!7 and connected to the paper feed rollers 546 and the rolled-paper cutting means 549; and a driven-side connecting gear 571 disposed at the gear mechanism G and adapted to be meshed with the drive-side connecting gear 569 when the unit body 537 is located in the upper position (See FIG. 24**).

Figure 25:
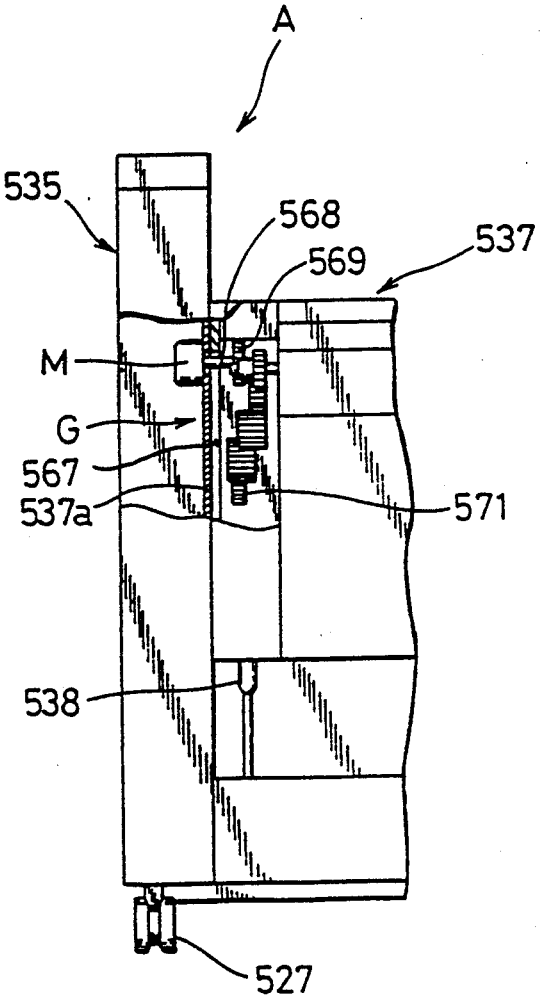
FIG. 25 is a schematic section view of the movable body located in a lower retreated position in the fifth embodiment in FIG. 21.

Referring to FIGS. 24 and 25, the driven-side connecting gear 571 is swingingly disposed. At the lowered retreat position (FIG. 25), the driven-side connecting gear 571 is disengaged from the drive-side connecting gear 569 and is located in a position lower than the drive-side connecting gear 569. At the upper position (FIG. 24), the driven-side connecting gear 571 is swung around the side of the drive-side connecting gear 569, so that the driven-side connecting gear 571 is meshed with the upper part of the drive-side connecting gear 569. There is disposed biasing means (not shown) for biasing the driven-side connecting gear 571 as meshed, toward the drive-side connecting gear 569.

According to the embodiment above-mentioned, the driven-side connecting gear 571 of the rolled-paper cutting mechanism B is meshed with the drive-side connecting gear 569 of the input shaft 568 when the unit body 537 is located in the upper position as supported by the unit frame 535. This enables the motor M to drive the rolled-paper cutting mechanism B. A paper sheet cut, at a predetermined timing, from the rolled paper 503 reeled out by the rolled-paper cutting mechanism B and fed to the manual paper feed port 504, is passed, after image forming, through the paper discharge rollers 523 and then discharged toward the rolled-paper feed unit A. While being guided by the paper discharge/guide plate 556 and the cover 555, the cut paper reaches the guide plate 558 serving as a guide member. The guide plate 558 causes the cut paper to be changed in passage direction so that the tip of the cut paper comes in contact with the bent portions **529*a* of the bent guide member 529 and the rear end of the cut paper comes out and falls from the guide member 558. Thus, the cut paper is guided to the bent guide member 529 and the tray 559**.

In the embodiment above-mentioned, the rolled paper 503 is cut to produce a cut sheet. It is therefore possible to obtain a large-size cut sheet without the corresponding space required as would be the case with paper feed in cassette.

On the other hand, when the unit body 537 is located in the lowered retreat position, the lateral side of the copying apparatus main body 501 at the manual paper feed port 504 side is opened. Accordingly, maintenance such as a jam processing or the like may be carried out on the copying apparatus main body 501 without the unit body 537 being a hindrance to such maintenance. Further, even though the switch is erroneously operated to drive the motor M at the time of maintenance, the rolled-paper cutting mechanism B is not driven to assure safe maintenance, since the drive-side connecting gear 569 is disengaged from the driven-side connecting ggear 571.

Further, the input shaft 568 is disposed at the side of the unit frame 535. This eliminates the need to form a slot in the end surface 535*a* of the unit frame 535 to permit the relative movement of the input shaft 568. However, it becomes necessary to form, in the end surface 537*a* of the unit body 537, the slot 567 for permitting the relative movement of the input shaft 568. However, the unit body 537 is vertically moved with the lateral ends thereof 537*a*, 537*b* held by and between the unit frame 535. This prevents the slot 567 of the unit body 537 from being exposed so that a finger of the user is inserted into the slot 567 at the time of the vertical movement of the unit body 537. Thus, safety is assured.

When the input shaft 568 is disposed in the unit body 537 which is movable, the slot for permitting the relative movement of the input shaft 568 is formed in the end surface 535*a* of the unit frame 535. Accordingly, when the movable unit body 537 is vertically moved, the slot is exposed, thus presenting a danger. It is therefore required to dispose a cover or the like to prevent a finger of the operator from reaching the slot. In the embodiment above-mentioned, such a cover or the like is not required, thus preventing the number of component elements from being increased.

When the input shaft 568 is attached to the unit body 537 which is movable, it is required to attach gears to the input shaft 568 after introduced into the unit frame 535. This makes it difficult to assemble these members. In the embodiment above-mentioned, however, the input shaft 568 is attached to the unit frame 535 which is stationary. This facilitates the assembling.

Cut paper to be fed from the paper feed cassette 509 or cut paper to be manually fed through the manual paper feed port 504 is fed by the existing paper feed mechanism in the copying apparatus main body 501 and then delivered to the bent guide member 529 and the tray 559 through the paper discharge passage as done with a paper sheet cut from the rolled paper 503. Thus, the present invention may use an existing copying apparatus and provide a new paper feed system from rolled paper, in addition to the existing paper feed mechanism. Accordingly, the present invention is very versatile.

In the embodiment above-mentioned, the input shaft 568 is formed by the motor M drive shaft. Alternately, this input shaft 568 may be formed by a gear shaft in the gear mechanism G. In this case, the gear mechanism G may be disposed as divided into two portions in the unit frame 535 and the unit body 537. Accordingly, the degree of freedom as to the layout of the gear mechanism G may be increased in view of space.

It is a matter of course that the present invention may be embodied in other various manners than those above-mentioned, without departing from the spirit and main features of the present invention. Thus, the embodiments discussed hereinbefore should not be limitative but are shown only by way of example. The scope of the present invention should be defined by the appended claims and should not be bound on the specification. All equivalent alterations and modifications of the present invention within the appended claims should be included in the present invention.

We claim:

1. A rolled-paper feed unit for an image forming apparatus comprising:

a movable body including a rolled-paper mounting portion, a paper feed means for reeling out and feeding rolled paper to a paper feed port disposed at the front of a main body of an image forming apparatus, and a rolled-paper cutting means for cutting the rolled paper reeled out and fed by said paper feed means into a cut sheet having a predetermined length;

a stationary frame holding said movable body vertically moved from an upper position, where the rolled paper is fed, to a lower retreated position where an operator can carry out certain operations; and a movable body biasing means obliquely disposed between a bottom of said movable body and a bottom frame of said stationary frame for biasing said movable body toward said upper position.

2. A rolled-paper feed unit for an image forming apparatus according to claim 1, wherein said movable body biasing means is formed by a gas spring; said movable body has: a notch opened in an under side and lateral side of said movable body, a pivot pin projecting from said lateral side of said movable body and disposed in said notch, and a securing member having a plate portion for preventing said pivot pin engaging in a groove opening at a transverse portion of said plate portion from leaving said groove, and a lateral side cover portion for closing an underside of said notch; said securing member is fixed to said movable body by a fixing member with said pivot pin passing through a pin hole in a connecting plate on an upper end of said gas spring and said pivot pin is engaged with said plate portion of said securing member disposed between said connection plate and a large diameter head on said pivot pin extending from said pin hole of said connection plate.

3. A rolled-paper feed unit for an image forming apparatus according to claim 1, and further comprising a position regulating means at opposite sides in an axial direction of said rolled paper for upwardly regulating said movable body, and a fixing means for fixing said movable body regulated upwardly to the stationary frame.

4. A rolled-paper feed unit for an image forming apparatus according to claim 3, wherein said position regulating means has a position regulating member and a position regulated member being in contact with each other with the upward movement of said movable body; said fixing means has said position regulating member and a hook member holding said position regulated member together with said position regulating member, a biasing means for biasing said hook member to a retention position, and a cam mechanism for switching said hook member to a release position against the biasing force of said biasing means with the vertical movement of said movable body.

5. A rolled-paper feed unit for an image forming apparatus according to claim 3, wherein said stationary frame has a lock means for locking said movable body at a predetermined upper position against the downward pushing force, and a lock release means for releasing said movable body held by said lock means.

6. A rolled-paper feed unit for an image forming apparatus according to claim 3, wherein said stationary frame is removably connected at a side of said paper feed port to said image forming apparatus main body by a connecting means.

7. A rolled-paper feed unit for an image forming apparatus according to claim 1 wherein said stationary frame has vertical frames and a guide rail disposed at a front side and a rear side of said vertical frames; said movable body has: a vertically movable frame forming both lateral sides thereof, support shafts disposed at said vertically movable frame, and rollers supported by said support shafts and rotatably fitted to said guide rails.

8. A rolled-paper feed unit for an image forming apparatus according to claim 7 wherein said support shafts contain a support shaft supporting one of said rollers facing to said image forming apparatus main body and has an axis extending in a transverse direction of said unit, and a support shaft supporting said roller apart from said image forming apparatus main body and has an axis extending in a front-to-back direction of said unit.

9. A rolled-paper feed unit for an image forming apparatus according to claim 1, wherein said movable body has a drive system for said rolled-paper cutting means, said drive system is connected to a drive means mounted on said stationary frame through a power transmission mechanism in which an engagement state is released with the downward movement of said movable body from the upper position.

10. A rolled-paper feed unit for an image forming apparatus according to claim 1, wherein one of said movable body and said stationary frame has a pair of vertically extending racks provided with a predetermined space therebetween, and the other of said movable body and said stationary frame has a pair of integrally rotatable pinions meshed with said racks.

11. A rolled-paper feed unit for an image forming apparatus comprising:

a movable body for reeling out and feeding rolled paper and for cutting said rolled paper into cut sheet having a predetermined length;

a stationary frame holding said movable body vertically moved from an upper position, where said rolled paper is fed, to a lower retreated position where an operator can carry out certain operations;

a position regulating means at opposite sides in an axial direction of said rolled paper for upwardly regulating said movable body;

a fixing means for fixing said movable body regulated upwardly to said stationary frame;

wherein said movable body including:

a rolled paper mounting portion, a paper feed means for reeling out and feeding said rolled paper to a paper feed port disposed at a front of a main body of an image forming apparatus, a rolled-paper cutting means for cutting said rolled paper reeled out and fed by said paper feed means into a cut sheet having a predetermined length.

12. A rolled-paper feed unit for an image forming apparatus according to claim 11, wherein said stationary frame is removably connected at a side of said paper feed port to said image forming apparatus main body by a connecting means.

13. A rolled-paper feed unit for an image forming apparatus according to claim 11, wherein said stationary frame has a bottom frame having corners at which caster wheels are supported by screw shafts.

14. A rolled-paper feed unit for an image forming apparatus according to claim 11, wherein said position regulating means has a position regulating member and a position regulated member being in contact with each other with the upward movement of said movable body; said fixing means has said position regulating member and a hook member holding said position regulated member together with said position regulating member, a biasing means for biasing said hook member to a retention position, and a cam mechanism for switching said hook member to a release position against the biasing force of said biasing means with the vertical movement of said movable body.

15. A rolled-paper feed unit for an image forming apparatus according to claim 11, wherein said stationary frame has a lock means for locking said movable body at a predetermined upper position against the downward pushing force and a lock release means for releasing said movable body held by said lock means.

16. A rolled-paper feed unit for an image forming apparatus according to claim 15, wherein said lock means has a hook member engaged with a predetermined portion of said movable body in said upper portion and a biasing member for biasing said hook member to the engagement position; and said lock release means has a pushing member for pushing said hook member against the biasing force of said biasing member and a stopper for maintaining said hook member pushed by said pushing member.

17. A rolled-paper feed unit for an image forming apparatus according to claim 11, wherein said stationary frame has vertical frames and a guide rail disposed at a front side and a rear side of said vertical frames; said movable body has: a vertically movable frame forming both lateral sides thereof, support shafts disposed at said vertically movable frame, and rollers supported by said support shafts and rotatably fitted to said guide rails.

18. A rolled-paper feed unit for an image forming apparatus according to claim 17, wherein said support shafts contain a support shaft supporting one of said rollers facing to said image forming apparatus main body and has an axis extending in a transverse direction of said unit and a support shaft supporting said roller apart from said image forming apparatus main body and has an axis extending in a the front-to-back direction of said unit.

19. A rolled-paper feed unit for an image forming apparatus according to claim 11, wherein said movable body has a drive system for said rolled-paper cutting means, said drive system is connected to a drive means mounted on said stationary frame through a power transmission mechanism in which an engagement state is released with the downward movement of said movable body from the upper position.

20. A rolled-paper feed unit for an image forming apparatus according to claim 19, wherein said drive means has a drive mounted on said stationary frame for driving said rolled-paper cutting means, and a power transmission shaft introduced for transmitting the power of said drive to said rolled-paper cutting means to an inside of said movable body by vertically movably passing through an elongated hole formed in an end surface of said movable body; said power transmission mechanism has a drive-side connecting gear integrally rotatably mounted on the introduced end of said power transmission shaft placed at a side of side movable body and a driven-side connecting gear disposed at said rolled-paper cutting means and meshed with said drive-side connecting gear when said driven-side connecting gear is located in said upper position.

21. A rolled-paper feed unit for an image forming apparatus according to claim 19, wherein said drive means has a drive mounted on said stationary frame for driving said rolled-paper cutting means, and an output shaft for transmitting the power of said driven to said rolled-paper cutting means; said power transmission mechanism has: an output gear integrally rotatably mounted on said output shaft, an output-side gear meshed with said output gear, an input gear meshed with said output-side gear, an input shaft supporting said input gear and being restricted from the upward movement as supported by said movable body, a transmission mechanism connected to said input shaft, and a gear mechanism meshed with an output gear of said transmission mechanism.

22. A rolled-paper feed unit for an image forming apparatus according to claim 21, wherein said power transmission mechanism has: a gear bracket for supporting said output shaft and for rotatably holding said output-side gear, a gear bracket biasing means for swinging said gear bracket by biasing toward said input gear located in said paper feed position, and a stopper for preventing said gear bracket from being swung against the biasing force of said gear bracket biasing means.

23. A rolled-paper feed unit for an image forming apparatus according to claim 11, wherein one of said movable body and said stationary frame has a pair of vertically extending racks provided with a predetermined space therebetween, and the other of said movable body and said stationary frame has a pair of integrally rotatable pinions meshed with said racks.

24. A rolled-paper feed unit for an image forming apparatus comprising:

a movable body for reeling out and feeding rolled paper and for cutting said rolled paper into a cut sheet having a predetermined length;

a stationary frame holding said movable body vertically moved from an upper position, where said rolled paper is fed, to a lower retreated position where an operator can carry out certain operations;

wherein said movable body including:

a rolled paper mounting portion, a paper feed means for reeling out and feeding said rolled paper to a paper feed part disposed at a front of a main body of an image forming apparatus, a rolled-paper cutting means for cutting said rolled paper reeled out and fed by said paper feed means into a cut sheet having a predetermined length, a drive system for said rolled-paper cutting means, said drive system is connected to a drive means mounted on said stationary frame through a power transmission mechanism in which an engagement state is released with the downward movement of said movable body from the upper position.

25. A rolled-paper feed unit for an image forming apparatus according to claim 24, wherein said drive means has a drive mounted on said stationary frame for driving said rolled-paper cutting means, and a power transmission shaft introduced for transmitting the power of said drive to said rolled-paper cutting means to an inside of said movable body by vertically movably passing through an elongated hole formed in an end surface of said movable body; and said power transmission mechanism has a drive-side connecting gear integrally rotatably mounted on the introduced end of said power transmission shaft placed at a side of said movable body and a driven-side connecting gear disposed at said rolled-paper cutting means and meshed with said drive-side connecting gear when said driven-side connecting gear is located in said upper position.

26. A rolled-paper feed unit for an image forming apparatus according to claim 24, wherein said driven means has a drive mounted on said stationary frame for driving said rolled-paper cutting means, and an output shaft for transmitting the power of said drive to said rolled-paper cutting means; said power transmission mechanism has an output gear integrally rotatably mounted on said output shaft, an output-side gear meshed with said output gear, an input gear meshed with said output-side gear, and an input shaft supporting said input gear and being restricted from the upward movement as supported by said movable body, a transmission mechanism connected to said input shaft, and a gear mechanism meshed with an output gear of said transmission mechanism.

27. A rolled-paper feed unit for an image forming apparatus according to claim 26, wherein said rolled-paper mounting portion, said paper feed means, and said rolled-paper cutting means are mounted on a swinging bracket pivotally disposed on said movable body adapted to swing toward said image forming apparatus main body.

28. A rolled-paper feed unit for an image forming apparatus according to claim 26, wherein said power transmission mechanism has: a gear bracket for supporting said output shaft and for rotatably holding said output-side gear, a gear bracket biasing means for swinging said gear bracket by biasing toward said input gear located in said paper feed position, and a stopper for preventing said gear bracket from being swung against the biasing force of said gear bracket biasing means.

29. A rolled-paper feed unit for an image forming apparatus according to claim 24, and further comprising: a position regulating means at opposite sides in an axial direction of said rolled paper for upwardly regulating said movable body; a fixing means for fixing said movable body regulated upwardly to said stationary frame; wherein said stationary frame has a lock means for locking said movable body at a predetermined upper position against a downward pushing force and a lock release means for releasing said movable body held by said lock means.

30. A rolled-paper feed unit for an image forming apparatus according to claim 29, wherein said lock means has a hook member engaged with a predetermined portion of said movable body in said upper portion and a biasing member for biasing said hook member to the engagement position, and said lock release means has a pushing member for pushing said hook member against the biasing force of said biasing member and a stopper for maintaining said hook member pushed by said pushing member.

31. A rolled-paper feed unit for an image forming apparatus according to claim 24, wherein said stationary frame has vertical frames and a guide rail disposed at a front side and a rear side of said vertical frames; said movable body has: a vertically movable frame forming both lateral sides thereof, support shafts disposed at said vertically movable frame, and rollers supported by said support shafts and rotatably fitted to said guide rails.

32. A rolled-paper feed unit for an image forming apparatus according to claim 24, wherein one of said movable body and said stationary frame has a pair of vertically extending racks provided with a predetermined space therebetween, and the other of said movable body and said stationary frame has a pair of integrally rotatable pinions meshed with said racks.

33. A rolled-paper feed unit for an image forming apparatus comprising:

a movable body for reeling out and feeding rolled paper and for cutting said rolled paper into a cut sheet having a predetermined length;

a stationary frame holding said movable body vertically moved from an upper position, where said rolled paper is fed, to a lower restricted position where an operator can carry out certain operations;

wherein said movable body including:

a rolled paper mounting portion, a paper feed means for reeling out and feeding said rolled paper to a paper feed port disposed at a front of a main body of an image forming apparatus, a rolled-paper cutting means for cutting said rolled paper reeled out and fed by said paper feed means into a cut sheet having a predetermined length, one of said movable body and said stationary frame has a pair of vertically extending racks provided with a predetermined space therebetween, and the other of said movable body and said stationary frame has a pair of integrally rotatable pinions meshed with said racks.

34. A rolled-paper feed unit for an image forming apparatus according to claim 33, wherein said stationary frame has at opposite sides in an axial direction of said rolled paper, a position regulating means for upwardly regulating said movable body, and a fixing means for fixing said movable body regulated upwardly to said stationary frame.

35. A rolled-paper feed unit for an image forming apparatus according to claim 33, wherein said stationary frame has vertical frames and a guide rail disposed at the front and rear sides of said vertical frames; said movable body has: a vertically movable frame forming both lateral sides thereof, support shafts disposed at said vertically movable frame, and rollers supported by said support shafts and rotatably fitted to said guide rails; said racks is disposed along with said guide rail, and said pinions are coaxially disposed with said rollers.

36. A rolled-paper feed unit for an image forming apparatus according to claim 35, wherein said support shafts contain a support shaft supporting one of said rollers facing to said image forming apparatus main body and has an axis extending in a transverse direction of said unit, and a support shaft supporting said roller apart from said image forming apparatus main body and has an axis extending in a front-to-back direction of said unit; and said pinions are coaxially disposed with said rollers aligned with said image forming apparatus main body.

37. A rolled-paper feed unit for an image forming apparatus according to claim 33, wherein said movable body has a drive system for said rolled-paper cutting means, said drive system is connected to a drive means mounted on said stationary frame through a power transmission mechanism in which an engagement state is released with a downward movement of said movable body from the paper feed position, said drive means has: a drive mounted on said stationary frame for driving said rolled-paper cutting means, and a power transmission shaft introduced for transmitting the power of said drive to said rolled-paper cutting means to an inside of said movable body by vertically movably passing through an elongated hole formed in an end surface of said movable body; and said power transmission mechanism has a drive-side connecting gear integrally rotatably mounted on the introduced end of said power transmission shaft placed at a side of said movable body and a driven-side connecting gear disposed at said rolled-paper cutting means and meshed with said drive-side connecting gear when said driven-side connecting gear is located in said upper position.

* * * * *